US005758236A

United States Patent [19]

Teschendorf et al.

[11] Patent Number: 5,758,236

[45] Date of Patent: May 26, 1998

[54] DEVELOPMENT APPARATUS FOR A LIQUID ELECTROGRAPHIC IMAGING SYSTEM

[75] Inventors: Brian P. Teschendorf, St. Paul; Truman F. Kellie, Lakeland; Edward J. Moe, St. Paul; W. Blake Kolb, St. Paul; Joseph T. Brophy, St. Paul; Thomas M. Milbourn, Mahtomedi; Arthur V. Lang, Maplewood; Donald H. Larson, Stillwater; Alberto Goenaga, St. Paul; Steven C. Jensen, Maplewood; John D. Watson, Centerville, all of Minn.

[73] Assignee: Minnesota Mining and Manufacturing Company, Saint Paul, Minn.

[21] Appl. No.: 720,168

[22] Filed: Sep. 25, 1996

Related U.S. Application Data

[63] Continuation of Ser. No. 536,135, Sep. 29, 1995, Pat. No. 5,576,815.

[51] Int. Cl.[6] ..... G03G 15/10

[52] U.S. Cl. ..... 399/249; 15/256.51; 492/18; 492/56

[58] Field of Search ..... 355/256, 245; 15/256.51, 256.52; 118/652; 492/18, 56; 399/249, 348

[56] References Cited

U.S. PATENT DOCUMENTS

| | | | |
|---|---|---|---|
| Re. 34,437 | 11/1993 | Ariyama et al. | 399/225 |
| 3,654,659 | 4/1972 | Blumenthal | 15/309.1 |
| 3,710,469 | 1/1973 | Kitazawa | 492/40 |
| 3,741,643 | 6/1973 | Smith et al. | 399/249 |
| 3,750,246 | 8/1973 | Pessen | 492/56 X |
| 3,815,989 | 6/1974 | Davis et al. | 399/249 |
| 3,843,407 | 10/1974 | Thorp | 134/6 |

(List continued on next page.)

FOREIGN PATENT DOCUMENTS

| | | |
|---|---|---|
| 0 575 698 | 12/1993 | European Pat. Off. . |
| 0 657 786 A1 | 6/1995 | European Pat. Off. . |
| 53-22435 | 1/1978 | Japan . |
| 55-015190 | 2/1980 | Japan . |
| 55-106480 | 8/1980 | Japan . |
| 60-060678 | 4/1985 | Japan . |
| 63-266475 | 11/1988 | Japan . |
| 2196267 | 8/1990 | Japan . |
| 4-69680 | 3/1992 | Japan . |
| 4125672 | 4/1992 | Japan . |
| 5-19634 | 1/1993 | Japan . |
| 5027653 | 2/1993 | Japan . |
| 6-95472 | 4/1994 | Japan . |
| 1 579 405 | 11/1980 | United Kingdom . |

OTHER PUBLICATIONS

IBM Technical Disclosure Bulletin, Jun. 1984, vol. 27, No. 1A, pp. 170–171, XP002021186, "Uniform Pressure Roll".

*Primary Examiner*—Arthur T. Grimley
*Assistant Examiner*—Sophia S. Chen
*Attorney, Agent, or Firm*—William D. Bauer

[57] ABSTRACT

A development apparatus for developing a latent electrostatic image on an imaging substrate in a liquid electrographic imaging system includes a cleaning roller for removing back-plated developer from a development device such as a development roller, and a squeegee apparatus for removing both "drip-line" developer liquid and "wrap-around" developer liquid from the imaging substrate. The squeegee apparatus may include a squeegee roller having a crowned profile and a loading mechanism configured to achieve a uniform loading force across a pressure nip formed between the squeegee roller and the imaging substrate. The cleaning roller may include a fiber cleaning media and fluid delivery means for flushing back-plated developer from the cleaning media. The development apparatus also may include means for spacing the development apparatus relative to the imaging substrate without contacting the imaging substrate, thereby avoiding disruption of the motion quality of the imaging substrate.

28 Claims, 17 Drawing Sheets

U.S. PATENT DOCUMENTS

| | | | |
|---|---|---|---|
| 3,850,099 | 11/1974 | Laben | 15/256.51 X |
| 3,910,231 | 10/1975 | Inoue et al. | 399/225 |
| 3,940,282 | 2/1976 | Hwa | 134/6 |
| 3,955,533 | 5/1976 | Smith et al. | 399/249 |
| 4,181,094 | 1/1980 | Gardiner | 399/249 |
| 4,325,627 | 4/1982 | Swidler et al. | 399/249 |
| 4,395,113 | 7/1983 | Buchan et al. | 399/348 |
| 4,416,201 | 11/1983 | Kessler | 101/348 |
| 4,436,054 | 3/1984 | Ceelen et al. | 399/348 |
| 4,482,242 | 11/1984 | Moraw et al. | 399/249 |
| 4,627,705 | 12/1986 | Landa et al. | 399/225 |
| 4,640,605 | 2/1987 | Ariyama et al. | 399/225 |
| 4,669,859 | 6/1987 | Mochizuki et al. | 399/56 |
| 4,682,881 | 7/1987 | Komatsubara et al. | 399/249 |
| 4,728,987 | 3/1988 | Diola et al. | 399/229 |
| 4,801,965 | 1/1989 | Mochizuki et al. | 399/29 |
| 4,905,047 | 2/1990 | Ariyama | 399/102 |
| 4,935,788 | 6/1990 | Fantuzzo et al. | 399/299 |
| 4,956,211 | 9/1990 | Saito | 428/36.5 |
| 4,990,962 | 2/1991 | Kishi | 399/233 |
| 5,021,834 | 6/1991 | Tsuruoka et al. | 399/249 |
| 5,092,235 | 3/1992 | Rise | 100/168 |
| 5,122,839 | 6/1992 | Siegel et al. | 399/347 |
| 5,155,534 | 10/1992 | Kurotori et al. | 399/237 |
| 5,195,430 | 3/1993 | Rise | 100/168 |
| 5,220,384 | 6/1993 | Landa et al. | 399/245 |
| 5,221,944 | 6/1993 | Yoda et al. | 399/233 |
| 5,262,259 | 11/1993 | Chou et al. | 430/47 |
| 5,289,238 | 2/1994 | Lior et al. | 399/249 |
| 5,300,990 | 4/1994 | Thompson | 399/240 |
| 5,359,398 | 10/1994 | Echigo et al. | 399/71 |
| 5,369,477 | 11/1994 | Foote et al. | 399/102 |
| 5,374,980 | 12/1994 | Kubo et al. | 399/233 |
| 5,384,225 | 1/1995 | Kurotori et al. | 430/116 |
| 5,420,675 | 5/1995 | Thompson et al. | 399/237 |
| 5,420,676 | 5/1995 | Arcaro | 399/313 |
| 5,432,591 | 7/1995 | Geleynse | 399/249 |
| 5,463,453 | 10/1995 | Kurotori et al. | 399/249 |
| 5,576,815 | 11/1996 | Teschendorf et al. | 399/249 |

DEVELOPMENT APPARATUS FOR A LIQUID ELECTROGRAPHIC IMAGING SYSTEM

This is a continuation of application Ser. No. 08/536,135 filed Sep. 29, 1995 which became U.S. Pat. No. 5,576,815 on Nov. 19,1996

FIELD OF THE INVENTION

The present invention relates generally to liquid electrographic imaging technology and, more particularly, to techniques for developing a latent electrostatic image on an imaging substrate in a liquid electrographic imaging system.

DISCUSSION OF RELATED ART

A liquid electrographic imaging system includes an imaging substrate onto which a developer liquid is delivered to develop a latent image. A liquid electrographic imaging system may comprise as the imaging substrate a dielectric or a photoreceptor. A photoreceptor includes a photoconductive material. A latent image can be formed on a photoreceptor by selectively discharging the photoreceptor with a pattern of radiation, whereas a latent image can be formed on a dielectric by selectively discharging the dielectric with an electrostatic stylus. A liquid electrophotographic imaging system will be discussed for purposes of example.

A liquid electrophotographic imaging system generally includes a photoreceptor, an erasure station, a charging station, an exposure station, a development station, an image drying station, and a transfer station. The photoreceptor may take the form of a photoreceptor belt, a photoreceptor drum, or a photoreceptor sheet. For an imaging operation, the photoreceptor is moved past each of the stations in the liquid electrographic imaging system.

The erasure station exposes the photoreceptor to erase radiation sufficient to uniformly discharge any electrostatic charge remaining from a previous imaging operation. The charging station electrostatically charges the surface of the photoreceptor. The exposure station selectively discharges the surface of the photoreceptor to form a latent electrostatic image. A multi-color imaging system may include several exposure stations that form a plurality of latent images. Each of the latent images in a multi-color imaging system is representative of one of a plurality of color separation images for an original multi-color image to be reproduced.

As a latent image is formed, the development station delivers developer liquid to the photoreceptor via a development device such as a development roller to develop the latent image. In a multi-color imaging system, each of a plurality of development stations applies an appropriately colored developer liquid to the photoreceptor to form an intermediate representation of the corresponding color separation image. The drying station dries the developer liquid applied by the development station or stations. The transfer station then transfers the developer liquid applied by the development stations from the photoreceptor to an output substrate, such as a sheet of paper or film, to form a visible representation of the original image.

The operation of an electrographic imaging system as described above, generally is effective in producing a visible representation of an original multi-color image. However, the quality of the image remains a constant concern. In addition, economic consumption of developer liquid is desirable to maximize the number of images produced per unit volume of developer liquid. In multi-color imaging systems, avoidance of developer liquid cross-contamination also is a concern. Further, over time, components within the imaging system can require maintenance on a more frequent basis to ensure consistent image quality. Finally, motion quality of the imaging substrate can be disrupted, leading to inconsistent exposure and development. Reduced quality of the image, increased rate of developer liquid consumption, cross contamination of developer liquids, shortened maintenance cycles can occur, and reduced motion quality, in particular, due to a number of problems associated with the development station. A description of some of the problems follows.

As a first example, the development station can leave excess developer liquid on the imaging substrate. The development station typically includes a development device, such as a development roller or belt, and a squeegee roller. Use of a development roller will be discussed for purposes of example. A development roller is rotated by a drive mechanism, whereas the squeegee roller typically is passively driven by the photoreceptor. The biased, rotating development roller applies developer liquid to the surface of an imaging region of the photoreceptor to develop the latent image. The squeegee roller removes excess developer liquid from the photoreceptor to partially dry the developed image prior to application of the drying and transfer stations to the photoreceptor. Unfortunately, during operation, the development roller and squeegee roller can leave excess developer liquid on the photoreceptor.

A first excess volume of developer liquid is produced during delivery of developer liquid by the development roller for development of the latent image. Specifically, the development roller applies an amount of developer liquid that exceeds the amount necessary to develop the latent image. The passively driven squeegee roller typically serves to remove this first excess volume of developer liquid from the photoreceptor. The squeegee roller is loaded against the photoreceptor to form a nip that prevents excess developer liquid from passing downstream with the photoreceptor. The photoreceptor can be supported at the nip by a backup roller. The squeegee roller ordinarily comprises an elastomeric material mounted about a core. In operation, the excess developer liquid removed from the photoreceptor forms a hold-up volume on the upstream side of the nip.

A second excess volume of developer liquid is produced when delivery of developer liquid by the development roller is stopped. Delivery of developer liquid by the development roller can be stopped, for example, by disengaging the development roller from proximity with the photoreceptor, stopping the delivery of developer liquid to the development roller, or obstructing application of developer liquid from the development roller to the photoreceptor. In each case, a portion of the excess developer liquid remaining in the gap between the photoreceptor and the development roller tends to remain on the photoreceptor, producing a second excess volume of developer liquid on the photoreceptor. If the squeegee roller is also disengaged, a portion of the first excess volume of developer liquid also may remain on the photoreceptor. The excess volume of developer liquid remaining on the photoreceptor is sometimes referred to as a "drip line."

If the excess developer liquid is not removed from the photoreceptor, several problems can occur in the imaging process. First, in a multi-color imaging system, the excess developer liquid can cause cross contamination of differently colored developer liquids delivered by the various development stations. The cross contamination can degrade the quality of subsequent images over a period of time. Second, excessive developer liquid on the photoreceptor can contaminate the image being formed, causing incomplete image transfer from the photoreceptor and image staining. Third, internal components of the imaging system can become contaminated with developer liquid, possibly requiring a vigorous cleaning of the entire system. Fourth, any developer liquid that is not returned directly to the fluid return system of the development station is wasted. This wasted amount of developer liquid results in excessive consumption of developer liquid and decreases the number of images that can be formed for a given volume of developer liquid.

In view of the problems that can result from formation of excess developer liquid on an imaging substrate such as a photoreceptor in a liquid electrographic imaging system, there is a need for an improved development station incorporating means for effectively removing the excess developer liquid.

As a second example, during prolonged imaging sequences, the amount of developer liquid in the hold-up volume of the squeegee roller nip increases. Competing hydrodynamic fores govern the flow and distribution of developer liquid in the squeegee roller nip. For example, gravity forces pull the developer liquid downward along the outer surface of the squeegee roller and out of the nip. Viscous forces resulting from movement of the squeegee roller and photoreceptor oppose the gravity forces, retaining the developer liquid in the nip. For a wetting liquid, the maximum amount of liquid that can be held in the squeegee roller nip is ultimately determined by the balance between viscous forces and gravity forces.

Capillary or surface forces in the nip cusp act to draw the developer liquid laterally outward toward opposite ends of the squeegee roller. Regions of the squeegee roller at the opposite ends are outside of the imaging region of the photoreceptor, and therefore are substantially free of developer liquid. As the imaging sequence progresses, however, the developer liquid reaches the dry end regions and is sucked, or "wrapped," around the squeegee roller to the downstream side. The movement of developer liquid to the downstream side is sometimes referred to as "developer liquid wrap-around." Gradually, the developer liquid migrates laterally toward the center of the squeegee roller. A balance between capillary and hydrodynamic forces on the downstream side of the squeegee roller limits the advancement of the developer liquid wrap-around toward the center of the squeegee roller.

The wrap-around developer liquid creates a band of developer liquid on the downstream side of the squeegee roller. The squeegee roller transfers the band of developer liquid to the photoreceptor. The band of developer liquid is undesirable because it can produce excess developer liquid in the margins of the printed page, adversely affecting image quality. The wrap-around developer liquid also can result in contamination of differently colored developer liquids and components within a multi-color imaging system. Further, the wrap-around developer liquid cannot be reclaimed for use by the imaging system, resulting in excessive developer liquid consumption.

In view of the image quality, developer liquid contamination, and developer liquid consumption concerns raised by the developer liquid wrap-around problem described above, there is a need for an improved development station incorporating means for eliminating the above problems caused by developer liquid wrap-around.

As a third example, the squeegee roller can remove excess developer liquid in a nonuniform manner. The length of the squeegee roller is at least as long as the width of the imaging region of the photoconductor to effectively remove excess developer liquid from the imaging region. The diameter of the squeegee roller must be minimized due to space constraints within the overall imaging system. The squeegee roller is loaded against the photoconductor by applying loading force at opposite ends of the core. Application of loading force at opposite ends of the core can cause axial deflection of the right circular cylindrical core when the squeegee roller is loaded against the photoconductor.

The axial deflection causes the loading force along the nip between the squeegee roller and the photoconductor to be nonuniform. For example, the loading force at the midpoint of the squeegee roller can be significantly less than the loading force at the ends of the squeegee roller. Due to the length-to-diameter ratio of the squeegee roller, this nonuniformity is accentuated. Nonuniform loading force along the length of the squeegee roller can cause nonuniform removal of the excess developer liquid from the photoconductor. In particular, areas of the image at the center of the nip can be more wet than lateral areas. The wet areas can adversely affect the transfer of the developed image to intermediate rollers and the ultimate printing substrate. Therefore, the nonuniform operation of the squeegee roller along the width of the imaging region can cause visible nonuniformities in the developed image, degrading image quality in the ultimate printed image.

In view of the image quality concerns raised by the nonuniformities described above, there is a need for an improved development apparatus that incorporates a squeegee apparatus capable of achieving more uniform loading force along the length of a squeegee roller, and thus along the width of the imaging region of the photoconductor.

As a fourth example, during operation of the development station, back-plated developer particles can accumulate on the surface of the development roller. The term "back-plated" refers to an amount of developer that develops on the development roller due to a potential difference between the surface of the photoreceptor and the surface of the development roller. The developer liquid on the rotating development roller wets the surface of the photoreceptor, creating the development nip. When the imaging region of the photoreceptor enters the development nip, the background areas of the image are at a potential slightly higher than the development roller bias and the latent image is at a potential significantly lower than the development roller bias.

The potential difference between the development roller bias and the latent image results in "forward-plating" of developer liquid to the latent image. The potential difference between the background areas and the development roller bias results in "back-plating" of developer liquid to the surface of the development roller. The back-plated developer retains a small charge that, if allowed to accumulate, will affect the development vector necessary for proper image development. The accumulation of back-plated developer can cause inconsistent transfer of developer liquid to the surface of the photoreceptor. In addition, the back-plated developer can accumulate on other components in the development station, affecting delivery of developer liquid to the development roller.

To avoid excessive accumulation of back-plated developer on the development roller, it ordinarily is desirable to provide an apparatus for removing the back-plated developer. In existing liquid electrographic systems, the developer removal apparatus generally comprises a cleaning blade or cleaning roller. A cleaning blade scrapes developer away from the surface of the development roller. A cleaning roller is rotated to remove the back-plated developer from the development roller. The removed developer is carried away by the surface of the cleaning roller.

The back-plated developer removed from the development roller can accumulate on a cleaning blade or cleaning roller. The back-plated developer has a generally sludge-like consistency and can affect the cleaning efficiency of the cleaning blade or cleaning roller. When the accumulation becomes excessive, the cleaning blade or cleaning roller can actually transfer some of the accumulated developer back to the development roller, completely undermining the effectiveness of the developer removal apparatus. Excessive accumulation of back-plated developer requires replacement or cleaning of the cleaning blade or cleaning roller by a field service technician.

To reduce the number of maintenance operations, increase the time between maintenance operations, and to generally avoid the image quality problems associated with back-plated developer, there is a need for an improved development station that incorporates means for removing the back-plated developer from a development roller. In particular, there is a need for a development station that incorporates means capable of maintaining effective removal of back-plated developer from the development roller over an extended period of time.

As a fifth example, in existing development apparatuses, gapping rollers often are used to achieve a desired spacing between the imaging substrate and the development device. However, the gapping rollers can affect the motion quality of the imaging subtrate. In particular, the gapping rollers can disrupt the motion and/or orientation of the imaging substrate. Such disruption can affect the formation of the latent image due to an inconsistent spatial relationship between the exposure station and the imaging substrate. In addition, such disruption can cause nonuniformities in the developed image due to an inconsistent spatial relationship between the development device and the imaging substrate. Thus, the disruption can seriously affect image quality.

In view of the image quality concerns raised by the use of gapping rollers, there is a need for an improved development station incorporating means for achieving desired spacing between the development device and the imaging substrate without disrupting the motion quality of the imaging substrate.

SUMMARY OF THE INVENTION

The present invention is directed to a development apparatus for developing a latent electrostatic image on an imaging substrate in a liquid electrographic imaging system. The development apparatus may include a cleaning roller for removing back-plated developer from a development device such as a development roller. The cleaning roller may include a fiber cleaning media and fluid delivery means for flushing back-plated developer from the cleaning media. In addition, the development apparatus may include a squeegee apparatus having means for removing "drip-line" developer liquid and/or "wrap-around" developer liquid from the imaging substrate. The development apparatus further may comprise a squeegee apparatus having a squeegee roller with a crowned profile and a loading mechanism configured to achieve a substantially uniform loading force across a pressure nip formed between the squeegee roller and the imaging substrate. The development apparatus also may include means for spacing the development apparatus relative to the imaging substrate without contacting the imaging substrate, thereby avoiding disruption of the motion quality of the imaging substrate.

The advantages of the present invention will be set forth in part in the description that follows, and in part will be apparent from the description, or may be learned by practice of the present invention. The advantages of the present invention will be realized and attained by means particularly pointed out in the written description and claims, as well as in the appended drawings. It is to be understood, however, that both the foregoing general description and the following detailed description are exemplary and explanatory only, and not restrictive of the present invention, as claimed.

BRIEF DESCRIPTION OF THE DRAWINGS

The accompanying drawings are included to provide a further understanding of the present invention and are incorporated in and constitute a part of this specification. The drawings illustrate exemplary embodiments of the present invention and together with the description serve to explain the principles of the invention.

DETAILED DESCRIPTION OF THE PREFERRED EMBODIMENTS

Figure 1:
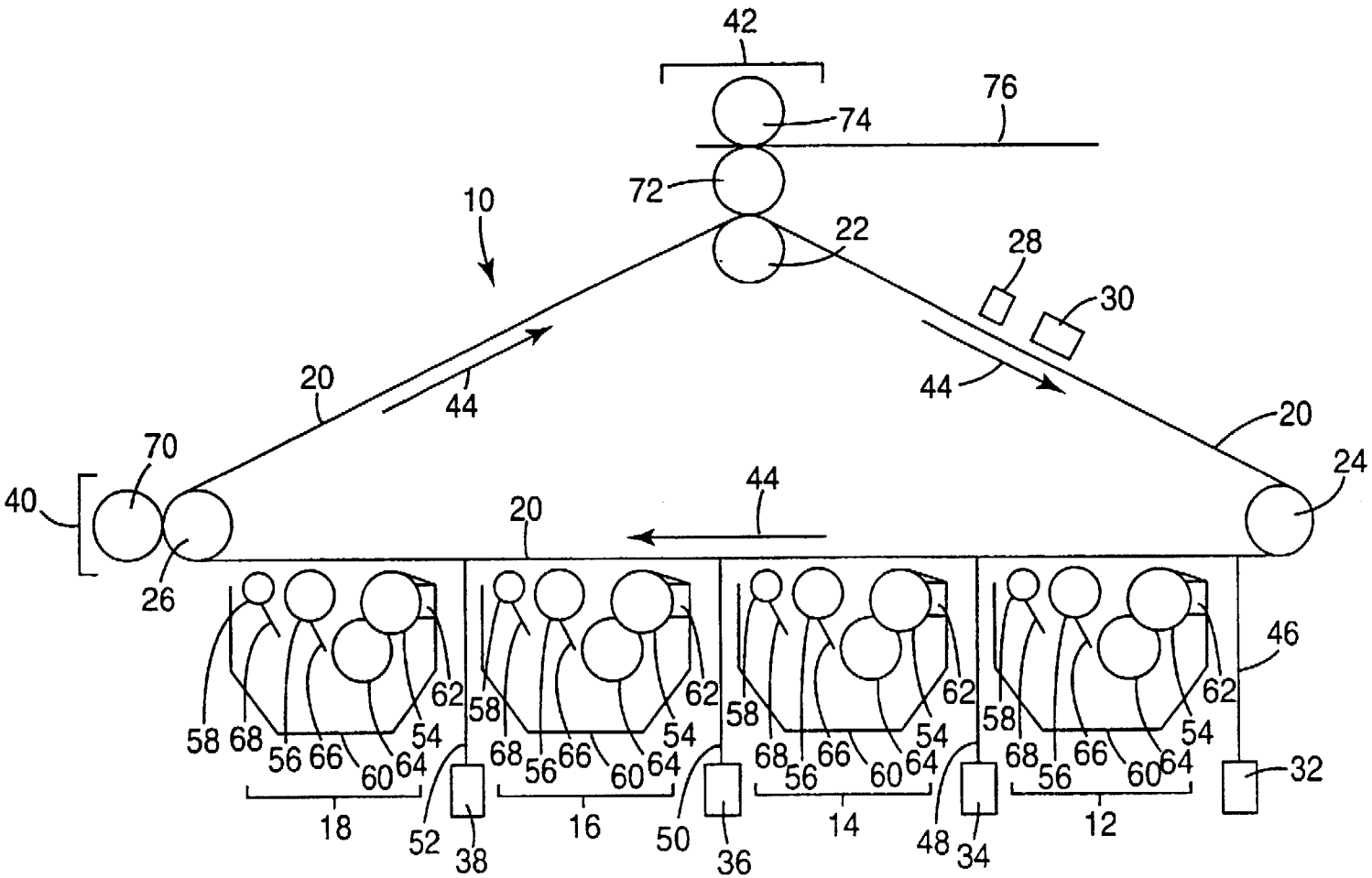
FIG. 1 is a schematic diagram of an exemplary liquid electrographic imaging system incorporating a development apparatus, in accordance with the present invention.

FIG. 1 is a schematic diagram of an exemplary liquid electrographic imaging system 10 incorporating a development apparatus, in accordance with the present invention. As shown in FIG. 1, the development apparatus may comprise a plurality of development stations 12, 14, 16, 18 distributed along the path of a photoconductor. The development apparatus will be described in detail later in this description. In FIG. 1, system 10 is shown as an electrophotographic imaging system having a photoreceptor 20 as an imaging substrate. The system 10 is configured to form a multi-color image in a single pass of a photoreceptor 20 associated with the system. The single-pass system 10 enables multi-color images to be assembled at extremely high speeds. An example of a liquid electrophotographic imaging system configured to assemble a multi-color image in a single pass of a photoreceptor is disclosed in copending and commonly assigned U.S. patent application Ser. No. 08/537/296 filed Sep. 29, 1995, entitled "METHOD AND APPARATUS FOR PRODUCING A MULTI-COLORED IMAGE IN AN ELECTROPHOTOGRAPHIC SYSTEM." The entire content of the above-referenced patent application is incorporated herein by reference.

Although imaging system 10 is shown as a multi-color/single-pass system in FIG. 1, the development apparatus of the present invention can be readily applied to both single-color liquid electrographic imaging systems and multi-color/multi-pass liquid electrographic imaging systems. In addition, the development apparatus of the present invention can be readily applied to systems in which the photoreceptor is configured as a photoreceptor belt, a photoreceptor drum, or a photoreceptor sheet. Similarly, the development apparatus of the present invention can be applied to multi-color/multi-pass, multi-color/single-pass, or single-color electrographic systems incorporating a dielectric belt, drum, or sheet as the imaging substrate. Therefore, incorporation of the apparatus of the present invention in the particular multi-color, single-pass electrophotographic imaging system 10 of FIG. 1 should be considered exemplary only.

As shown in FIG. 1, imaging system 10 includes photoreceptor 20 in the form of a continuous photoreceptor belt mounted about first, second, and third belt rollers 22, 24, 26, an erasure station 28, a charging station 30, a plurality of exposure stations 32, 34, 36, 38, development stations 12, 14, 16, 18, a drying station 40, and a transfer station 42. In operation of system 10, photoreceptor 20 is moved to travel in a first direction indicated by arrows 44. The photoreceptor 20 can be moved, for example, by activating a motor coupled to a rotor shaft associated with one of belt rollers 22, 24, 26. As photoreceptor 20 moves in first direction 44, erasure station 28 exposes the photoreceptor to erase radiation to uniformly discharge any electrostatic charge remaining from a previous imaging operation. The charging station 30 then charges the surface of photoreceptor 20 to a predetermined level.

The exposure stations 32, 34, 36, 38 emit beams 46, 48, 50, 52 of radiation that selectively discharge an imaging region of the charged photoreceptor 20 in an imagewise pattern to form a latent electrostatic image. Each of exposure stations 32, 34, 36, 38 may comprise, for example, a scanning laser module. For multi-color imaging, each of exposure stations 32, 34, 36, 38 forms a latent image representative of one of a plurality of color separation images of an original image to be reproduced. The combination of the color separation images produces an overall multi-color representation of the original image. The exposure stations 32, 34, 36, 38 emit radiation beams 46, 48, 50, 52, respectively, to form latent images in the same imaging region of photoreceptor 20. Thus, each of exposure stations 32, 34, 36, 38 forms a latent image on photoreceptor 20 as the imaging region passes the respective exposure station.

As further shown in FIG. 1, each of development stations 12, 14, 16, 18 may include a development device such as a development roller 54, a first squeegee roller 56, a second squeegee roller 58, a developer liquid recovery reservoir 60, a plenum 62 for delivering developer liquid to the development roller, a cleaning roller 64 for removing back-plated developer from the development roller, a first blade mechanism 66 for removing developer liquid from the first squeegee roller, and a second blade mechanism 68 for removing developer liquid from the second squeegee roller. Each of the first three development stations 12, 14, 16 also may include a corona (not shown in FIG. 1), which will be described later in this description. The development roller 54 is in fluid communication, via plenum 62, with a source of one of a plurality of differently colored developer liquids corresponding to the particular color separation to be developed. The developer liquid can be pumped from the source to plenum 62 for application to the surface of development roller 54. Alternatively, the surface of development roller 54 could be placed in contact with the source of developer liquid, or with another roller delivering developer liquid, eliminating the need for a pump and plenum 62. The differently colored developer liquids may correspond, for example, to cyan, magenta, yellow, and black color separations.

In this description, the term "developer liquid" generally refers to the liquid applied to an imaging substrate such as photoreceptor 20 to develop a latent image. The "developer liquid" may comprise both toner particles and a carrier liquid in which the toner particles are dispersed. A suitable carrier liquid may comprise, for example, hydrocarbon solvents such as NORPAR or ISOPAR solvents commercially available from Exxon. Examples of suitable developer liquids are disclosed in copending and commonly assigned U.S. patent application Ser. No. 08/536,856 filed Sep. 29, 1995, entitled "LIQUID INK USING A GEL ORGANOSOL." The entire content of the above-referenced patent application is incorporated herein by reference.

The development roller 54 can be made, for example, from stainless steel. Each of development stations 12, 14, 16, 18 may include means for engaging development roller 54 in proximity with photoreceptor 20 to develop the appropriate latent image in an imaging region of the photoreceptor. A suitable engaging means may comprise, for example, any of a variety of camming or gear-driven mechanisms configured to move one or both of development roller 54 and photoreceptor 20 relative to one another. During engagement, development roller 54 is positioned a short distance from the surface of photoreceptor 20, forming a gap. In addition, development roller 54 is moved to travel in first direction 44 by, for example, activating a motor coupled to a rotor shaft associated with the development roller. The development roller 54 supplies a thin, uniform layer of developer liquid across the gap to photoreceptor 20.

To carry out the development of developer liquid, each of development stations 12, 14, 16, 18 further includes an electrical bias means (not shown) that creates an electric field between development roller 54 and photoreceptor 20. The electric field develops the latent image previously formed by the respective exposure station 32, 34, 36, 38 with the developer liquid applied by development roller 54. The electrical bias means may comprise a charging circuit that applies to the surface of development roller 54 a charge that induces the electric field. The development roller 54 applies developer liquid to photoreceptor 20 only long enough to develop an imaging region of the photoreceptor. Upon completion of an imaging cycle and movement of a nonimaging region of photoreceptor 20 past development roller 54, the application of developer liquid by the development roller is terminated. The application of developer liquid can be terminated by, for example, disengaging development roller 54 from proximity with photoreceptor 20, turning off the supply of developer liquid to the development roller, or obstructing the application of developer liquid from the development roller with a blade or other obstructing element. For termination of developer liquid application by disengagement, development roller 54 can be disengaged by reverse action of the same mechanism used for engagement.

The development roller 54 in each development station can transfer an excessive amount of developer liquid to photoreceptor 20. The first squeegee roller 56 in each development station removes at least a portion of the excess developer liquid from photoreceptor 20 to partially dry the developed image. The first squeegee roller 56 is loaded against photoreceptor 20 with, for example, a spring mechanism to form a nip. The moving photoreceptor 20 drives first squeegee roller 56 by friction to rotate in the direction indicated by arrow 44. The rotating first squeegee roller 56 prevents excess developer liquid from passing through the nip and downstream with photoreceptor 20. The removal of excess developer liquid by first squeegee roller 56 results in partial drying of the developed image on photoreceptor 20.

The movement of photoreceptor 20 takes the latent images in the imaging region past each of development stations 12, 14, 16, 18 for development with the differently colored developer liquids applied by development rollers 54. After development stations 12, 14, 16, 18 have developed each of the latent images formed by exposure stations 32, 34, 36, 38, the imaging region of the moving photoreceptor 20 encounters drying station 40. The drying station 40 includes a heated roller 70 that forms a nip with belt roller 26. The heated roller 70 applies heat to photoreceptor 20 to dry the developer liquid applied by development stations 12, 14, 16, 18. An example of a suitable drying station is disclosed in copending and commonly assigned U.S. patent application Ser. No. 08/536,080, filed Sep. 29, 1995, entitled "DRYING METHOD AND APPARATUS FOR ELECTROPHOTOGRAPHY USING LIQUID TONERS.".

The imaging region of photoreceptor 20 next arrives at transfer station 42. The transfer station 42 includes an intermediate transfer roller 72 that forms a nip with photoreceptor 20 over belt roller 22 and a heated pressure roller 74 that forms a nip with the intermediate transfer roller. The developer liquid on photoreceptor 20 transfers from the photoreceptor surface to intermediate transfer roller 72 by selective adhesion. The heated pressure roller 74 serves to transfer the image on intermediate transfer roller 72 to an output substrate 76 by application of pressure and/or heat to the output substrate. The output substrate 76 may comprise, for example, paper or film. In this manner, transfer station 42 forms a visible representation of the original multi-color image on output substrate 76. An example of a suitable transfer station is disclosed in copending and commonly assigned U.S. patent application Ser. No. 08/536,687 filed Sep. 29, 1995, entitled "METHOD AND APPARATUS HAVING IMPROVED IMAGE TRANSFER CHARACTERISTICS FOR PRODUCING AN IMAGE ON PLAIN PAPER."

The operation of imaging system 10, as described above, generally is effective in producing a visible representation of an original multi-color image. However, the quality of the image remains a constant concern. In addition, economic consumption of developer liquid is desirable to maximize the number of images produced per unit volume of developer liquid. In multi-color imaging systems, avoidance of developer liquid cross-contamination also is a concern. Further, over time, components within the imaging system can require maintenance on a more frequent basis to ensure consistent image quality. Finally, motion quality of the imaging substrate can be disrupted, leading to inconsistent exposure and development. Reduced quality of the image, increased rate of developer liquid consumption, cross contamination of developer liquids, shortened maintenance cycles can occur, and reduced motion quality, in particular, due to a number of problems associated with the development station.

Image quality, developer consumption, and developer contamination concerns are raised, in particular, by the formation of excess developer liquid on the surface of photoreceptor 20. A first excess volume of developer liquid is produced on photoreceptor 20 during delivery of developer liquid by development roller 54 for development of the latent image. Specifically, development roller 54 applies an amount of developer liquid that exceeds the amount necessary to develop the latent image. The first squeegee roller 56 typically serves to remove this first excess volume of developer liquid from the photoreceptor 20.

A second excess volume of developer liquid is produced when delivery of developer liquid by development roller 54 is stopped. Delivery of developer liquid by development roller 54 can be stopped, for example, by disengaging the development roller from proximity with photoreceptor 20, stopping the delivery of developer liquid to the development roller, or obstructing the application of developer liquid from the development roller to the photoreceptor. In each case, a portion of the excess developer liquid remaining in the gap between photoreceptor 20 and development roller 54 tends to remain on the photoreceptor, producing a second excess volume of developer liquid on the photoreceptor. If first squeegee roller 56 is disengaged with development roller 54, a portion of the first excess volume of developer liquid also may remain on photoreceptor 20. With multiple development stations 12, 14, 16, 18, the amount of excess developer liquid can be increased, and cross contamination can occur.

In accordance with the present invention, each of development stations 12, 14, 16, 18 includes an apparatus for removing from photoreceptor 20 the excess developer liquid produced by development roller 54. With further reference to FIG. 1, the apparatus for removing excess developer liquid from photoreceptor 20 makes use of first squeegee roller 56 and means for removing developer liquid from the first squeegee roller. The developer liquid removing means may comprise, for example, first blade mechanism 66, as shown in FIG. 1, a vacuum, or a roller. The first squeegee roller 56 and first blade mechanism blade 66 are associated with each of development systems 12, 14, 16, 18.

The first squeegee roller 56 may comprise a compliant material and preferably comprises an elastomeric material that is inert to the developer liquid used in system 10. The first squeegee roller 56 may comprise, for example, a layer of urethane or nitrile mounted about a stainless steel, aluminum, or rigid plastic core. The elastomeric material may, for example, have a hardness of approximately 10 to 90, and preferably 50 to 70 durometer Shore A. The apparatus further makes use of a means for passively engaging first squeegee roller 56 with photoreceptor 20, the squeegee roller being driven by the photoreceptor in first direction 44. The first squeegee roller 56 can be loaded against photoreceptor 20, for example, by rigidly engaging the squeegee roller in contact with the photoreceptor or applying a spring bias. In either case, a thin developer liquid film typically will separate first squeegee roller 56 and photoreceptor 20.

During movement in first direction 44, first squeegee roller 56 removes from the imaging region of photoreceptor 20 a first excess volume of developer liquid applied by the respective development station 12, 14, 16, 18. In this first mode, first squeegee roller 56 serves to control the amount of developer liquid carried by photoreceptor 20, enabling the developed image to be effectively dried by drying station 40. The first squeegee roller 56 forms a developer liquid film comprising only a fraction of the developer liquid initially supplied to photoreceptor 20 by development roller 54. A loading force of approximately 5 to 15 pounds (2.3 to 6.9 kilograms), for example, applied to each end of a rotor shaft supporting first squeegee roller 56 has been observed to provide effective film forming of the developer liquid and removal of excess developer liquid during movement of the squeegee roller in the first direction. The imaging system 10 may include a backup roller or fixed backup shoe (not shown) on a side of photoreceptor 20 opposite first squeegee roller 56. The backup roller or shoe provides support for photoreceptor 20 in response to the loading of first squeegee roller 56.

Upon movement of the nonimaging region of photoreceptor 20 past first squeegee roller 56, the apparatus of the present invention operates to actively drive the squeegee roller in a second direction opposite to first direction 44. The first squeegee roller 56 can be moved in the second direction by, for example, activating a motor coupled to a rotor shaft associated with the squeegee roller. By the time the nonimaging region of photoreceptor 20 passes first squeegee roller 56, the application of developer liquid from development roller 54 disposed upstream from the squeegee roller will have been terminated. Thus, the nonimaging region will carry to first squeegee roller 56 a second excess volume of developer liquid remaining on photoreceptor 20 by such termination of developer liquid application. The second excess volume is sometimes referred to as a "drip line." In this second mode, the reverse movement of first squeegee roller 56 substantially removes the second excess volume of developer liquid from photoreceptor 20. The loading force applied to the ends of the rotor shaft of first squeegee roller 56 during passive movement in the first direction can be maintained during movement of the squeegee roller in the second direction. A loading force of approximately 1 to 3 pounds (0.45 to 1.35 kilograms) applied to each end of the rotor shaft of first squeegee roller 56 has been observed to provide effective developer liquid removal during movement of the squeegee roller in the second direction. Effective developer liquid removal likely can be carried out with less loading force or more loading force applied to first squeegee roller 56. However, excessive loading force may produce excessive wear on the release layer of photoreceptor 20 and may make first squeegee roller 56 more difficult to drive.

Advantageously, first squeegee roller 56 can be realized by adapting a squeegee roller already provided in development station 12, 14, 16, 18 for controlling the thickness of developer liquid on photoreceptor 20. A clutch and drive mechanism can be added to enable first squeegee roller 56 to be driven in the second direction. Thus, the incorporation of another component for excess developer liquid removal is unnecessary. Consequently, the apparatus of the present invention adds little cost and consumes little additional space within overall imaging system 10, while significantly increasing image quality relative to existing imaging systems. If added cost and conservation of space are not critical issues, the incorporation of an additional squeegee roller in each of development stations 12, 14, 16, 18 is conceivable. The original first squeegee roller 56 could be passively driven in first direction 44 by photoreceptor 20 and used for removing the first excess volume of developer liquid, whereas the additional squeegee roller could be actively driven in the second, reverse direction and used to remove the second excess volume of developer liquid. As another alternative, if recovery of developer liquid is not a concern, a single squeegee roller can be placed after the final development station 18 and used to remove the second excess volume of developer liquid produced by all of development stations 12, 14, 16, 18.

FIGS. 2–9 serve to further illustrate the problems presented by excess developer liquid on photoreceptor 20, and the operations carried out by a developer apparatus and method incorporating an apparatus and method for removing such excess developer liquid from a photoreceptor, in accordance with the present invention.

Figure 2:
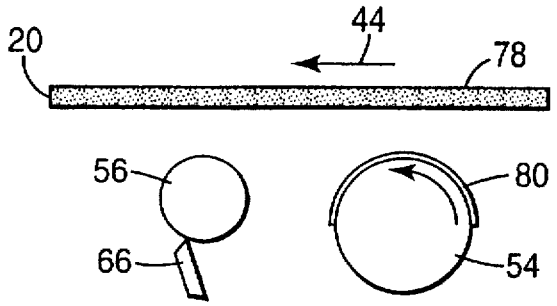
FIG. 2 is a schematic diagram illustrating a first operation carried out by a first squeegee apparatus for removing "drip line" developer liquid from an imaging substrate, in accordance with the present invention.

FIG. 2 is a schematic diagram illustrating a first operation carried out by a development apparatus and method incorporating an apparatus and method for removing excess developer liquid from photoreceptor 20, in accordance with the present invention. For simplicity, FIG. 2 shows photoreceptor 20 and only one of development stations 12, 14, 16, 18. As in the example of FIG. 1, the development station of FIG. 2 incorporates development roller 54, first squeegee roller 56, and a developer liquid removing means in the form of first blade mechanism 66. As shown in FIG. 2, to form an image, photoreceptor 20 is first moved in first direction 44. During the movement of a nonimaging region 78 of photoreceptor 20, development roller 54 and first squeegee roller 56 may remain disengaged from proximity and contact, respectively, with the photoreceptor. During disengagement, a uniform delivery of developer liquid to development roller 54 may be established. As shown in FIG. 2, development roller 54 carries a thin, uniform layer 80 of developer liquid received from plenum 62 (not shown in FIG. 2).

Figure 3:
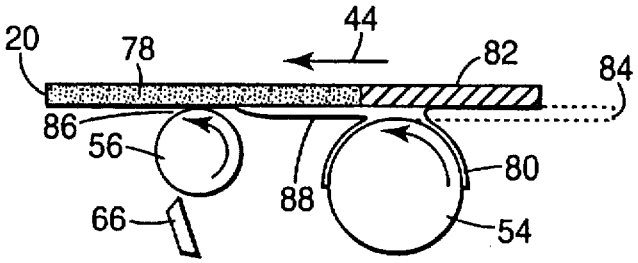
FIG. 3 is a schematic diagram illustrating a second operation carried out by a first squeegee apparatus for removing "drip line" developer liquid from an imaging substrate, in accordance with the present invention.

FIG. 3 is a schematic diagram illustrating a second operation carried out by a development apparatus and method incorporating an apparatus and method for cleaning excess developer liquid from photoreceptor 20, in accordance with the present invention. As shown in FIG. 2, prior to movement past development roller 54 of an imaging region 82 of photoreceptor 20, the development roller is engaged in proximity with the photoreceptor, forming a small gap 84. The development roller 54 applies developer liquid across gap 84 to imaging region 82 of photoreceptor 20. The electrical bias means associated with development roller 54 is activated to create an electric field that develops the latent image in imaging region 82 with the developer liquid applied by the development roller. As development roller 54 is engaged in proximity with imaging region 82 of photoreceptor 20, first squeegee roller 56 is loaded against the photoreceptor. The loading of first squeegee roller 56 against photoreceptor 20 forms a nip 86 in which a thin developer liquid film is formed. The movement of photoreceptor 20 in first direction 44 serves to drive first squeegee roller 56 in the first direction by friction. The first squeegee roller 56 is positioned to control an amount of developer liquid 88 remaining on photoreceptor 20 after delivery by development roller 54.

Figure 4:
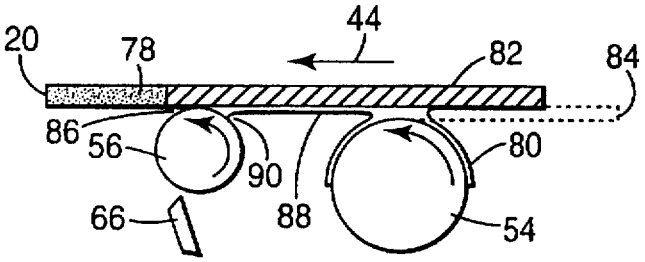
FIG. 4 is a schematic diagram further illustrating a second operation carried out by a first squeegee apparatus for removing "drip line" developer liquid from an imaging substrate, in accordance with the present invention.

FIG. 4 is a schematic diagram further illustrating the second operation carried out by a development apparatus incorporating an apparatus and method for cleaning excess developer liquid from photoreceptor 20, in accordance with the present invention. As shown in FIG. 4, imaging region 82 carries developer liquid 88 into nip 86, forming a holdup volume 90 on the upstream side of first squeegee roller 56, relative to first direction 44. The first squeegee roller 56 generally prevents this holdup volume from passing downstream with photoreceptor 20, thereby reducing the amount of developer liquid 88 carried by the developed latent image in imaging region 82. However, a fractional amount of film-formed developer liquid passes through first squeegee roller 56 on the surface of photoreceptor 20 as the developed image. Throughout this second operation, first blade mechanism 66 preferably remains disengaged from passively driven first squeegee roller 56. If first blade mechanism 66 were engaged with first squeegee roller 56, the force of the blade could alter or stop the passive movement of the squeegee roller in response to loading against photoreceptor 20.

Figure 5:
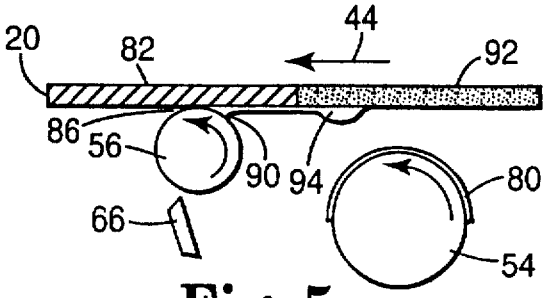
FIG. 5 is a schematic diagram illustrating a third operation carried out by a first squeegee apparatus for removing "drip line" developer liquid from an imaging substrate, in accordance with the present invention.

FIG. 5 is a schematic diagram illustrating a third operation carried out by a development apparatus incorporating an apparatus and method for cleaning excess developer liquid from a photoreceptor, in accordance with the present invention. In this third operation, upon movement past development roller 54 of a nonimaging region 92 of photoreceptor 20, application of developer liquid by the development roller is terminated by, for example, disengaging the development roller from proximity with photoreceptor 20. The disengagement of development roller 54 leaves on photoreceptor 20 a second excess volume of developer liquid 94, sometimes referred to as a "drip line." While imaging region 82 moves past first squeegee roller 56, the first squeegee roller continues to be passively driven by the moving photoreceptor 20, and continues to produce holdup volume 90.

Figure 6:
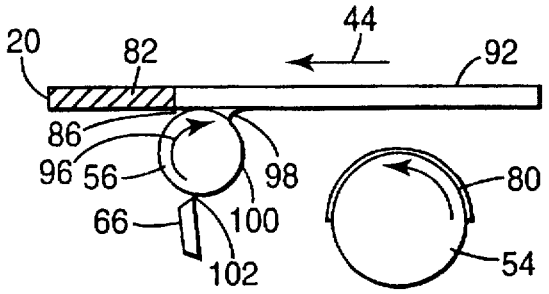
FIG. 6 is a schematic diagram illustrating a fourth operation carried out by a first squeegee apparatus for removing "drip line" developer liquid from an imaging substrate, in accordance with the present invention.

FIG. 6 is a schematic diagram illustrating a fourth operation carried out by a development apparatus incorporating an apparatus and method for cleaning excess developer liquid from photoreceptor 20, in accordance with the present invention. As shown in FIG. 6, upon movement of nonimaging region 92 of photoreceptor 20 past first squeegee roller 56, the apparatus of the present invention operates to actively drive the first squeegee roller in a second, reverse direction, indicated by arrow 96, opposite to first direction 44. The first squeegee roller 56 is driven in reverse direction 96 only after imaging region 82 has passed by the squeegee roller. If first squeegee roller 56 were driven in reverse direction 96 during passage of imaging region 82, the first squeegee roller could scrape away portions of developer liquid forming the developed image, significantly degrading image quality.

The reverse driven action of first squeegee roller 56 serves to substantially remove from photoreceptor 20 the second excess volume of developer liquid 94 left on the photoreceptor surface by development roller 54. The first squeegee roller 56 forms a larger holdup volume 98 that contains both the first excess volume of developer liquid applied in the development process and the second excess volume of developer liquid formed upon termination of the application of developer liquid by development roller 54. The reverse-driven first squeegee roller 56 prevents continued passage of holdup volume 98 downstream with photoreceptor 20. Moreover, the reverse driven action of first squeegee roller 56 directs the developer liquid in holdup volume 98 downward, as indicated by reference numeral 100, on the upstream side of the first squeegee roller. The rate at which the developer liquid can be removed from photoreceptor 20 is generally a function of the velocity ratio of the photoreceptor surface to the surface of first squeegee roller 56, the length of the squeegee roller, and the diameter of the squeegee roller. The developer liquid removal rate also may depend on the surface characteristics of the material forming first squeegee roller 56 and the fluid characteristics of the developer liquid.

As further shown in FIG. 6, the development apparatus also operates to engage first blade mechanism 66, or an alternative developer liquid removal means, 10 in contact with first squeegee roller 56, as indicated by reference numeral 102. The reverse motion of first squeegee roller 56 takes the holdup volume 98 of developer liquid away from nip 86 and transports the developer liquid downward. The first blade mechanism 66 removes from first squeegee roller 56 the developer liquid removed from photoreceptor 20 by the squeegee roller, and diverts the developer liquid to drain into developer liquid recovery reservoir 60 (not shown in FIG. 6). The first blade mechanism 66 provides first squeegee roller 56 with a clean surface for removal of additional developer liquid from photoreceptor 20 in the next revolution of the squeegee roller. Thus, first blade mechanism 66 greatly enhances the ability of first squeegee roller 56 to remove excess developer liquid from photoreceptor 20. The first blade mechanism 66 should maintain uniform contact pressure across the entire lateral width of the cylindrical first squeegee roller 56. Thus, first blade mechanism 66 preferably is made of a material selected so as to avoid warping or swelling. An example of a suitable material for formation of cleaning first blade mechanism 66 is Fluoroelastomer FC 2174, available from Minnesota Mining & Manufacturing Company (3M) of St. Paul, Minn.

As an example, if a first squeegee roller 56 having an outer Nitrile layer of approximately 50 to 70 durometer Shore A, a diameter of approximately 1.54 centimeters, and a length of approximately 23 centimeters, is driven in the second direction at approximately 20.32 centimeters per second, and loaded against a photoreceptor 20 moving in the first direction at approximately 10.16 centimeters per second with a loading force of approximately 0.45 to 1.35 kilograms applied at each end of the squeegee roller rotor shaft, excess developer liquid removal rate on the order of 1.6 cubic centimeters per second can be expected. Application of first blade mechanism 66 to remove developer liquid from first squeegee roller 56 is important for maintenance of the removal rate over time. An increase in the surface speed of first squeegee roller 56 can further increase the developer liquid removal rate.

Figure 7:
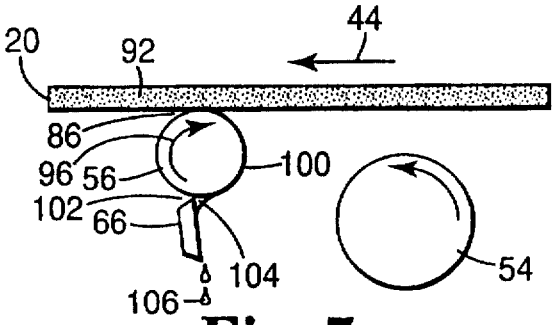
FIG. 7 is a schematic diagram further illustrating a fourth operation carried out by a first squeegee apparatus for removing "drip line" developer liquid from an imaging substrate, in accordance with the present invention.

FIG. 7 is a schematic diagram further illustrating the fourth operation carried out by a development apparatus incorporating an apparatus for cleaning excess developer liquid from photoreceptor 20, in accordance with the present invention. In particular, FIG. 7 further illustrates the cleaning action of cleaning first blade mechanism 66. As first squeegee roller 56 continues to move in second direction 96, cleaning excess developer liquid from nonimaging region 92 of photoreceptor 20, first blade mechanism 66 removes developer liquid from the squeegee roller, as indicated by reference numeral 104. The first blade mechanism 66 directs the developer liquid scraped from first squeegee roller 56 downward, as indicated by reference numeral 106, for collection by reservoir 60 associated with the particular development station. The developer liquid recovered by reservoir 60 (not shown in FIG. 7) can be recycled, thereby reducing developer liquid consumption in the overall system.

Figure 8:
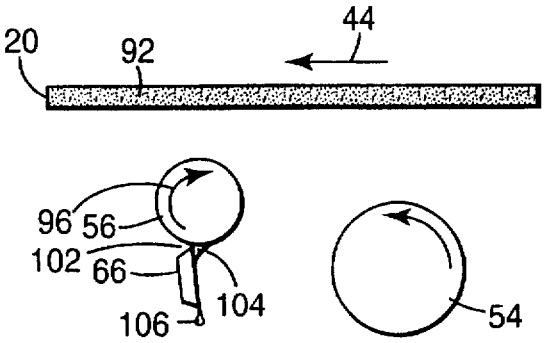
FIG. 8 is a schematic diagram illustrating a fifth operation carried out by a first squeegee apparatus for removing "drip line" developer liquid from an imaging substrate, in accordance with the present invention, in accordance wit he present invention.

FIG. 8 is a schematic diagram illustrating a fifth operation carried out by a development apparatus incorporating an apparatus for cleaning excess developer liquid from photoreceptor 20, in accordance with the present invention. In particular, FIG. 8 shows the disengagement of first squeegee roller 56 from contact with photoreceptor 20 after removal of the first and second excess volumes of developer liquid, and the continued engagement of first blade mechanism 66 in contact with the squeegee roller after disengagement. In this operation, first squeegee roller 56 continues to be driven in second direction 96 while first blade mechanism 66 removes any remaining developer liquid for recovery by reservoir 60 (not shown), as indicated by reference numerals 104 and 106.

Figure 9:
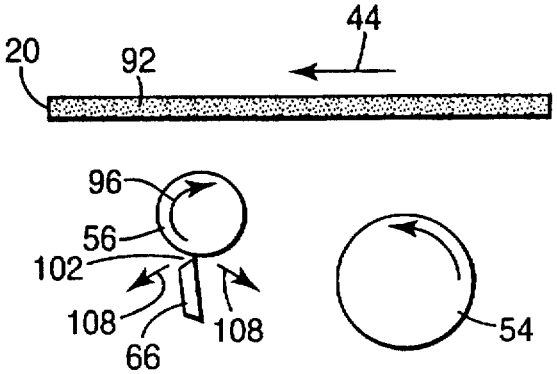
FIG. 9 is a schematic diagram illustrating a sixth operation carried out by a squeegee apparatus for removing "drip line" developer liquid from an imaging substrate, in accordance with the present invention.

FIG. 9 is a schematic diagram illustrating a sixth operation carried out by a development apparatus incorporating an apparatus for cleaning excess developer liquid from a photoreceptor, in accordance with the present invention. Upon disengagement, first squeegee roller 56 has eliminated the first and second excess volumes of developer liquid from photoreceptor 20. However, a small amount of developer liquid may cling to first squeegee roller 56 by surface tension at the squeegee roller/cleaning blade nip 102. As shown in FIG. 9, this operation involves the steps of disengaging first blade mechanism 66 from contact with first squeegee roller 56 and reengaging the blade in contact with the squeegee roller a plurality of times. For example, the edge of first blade mechanism 66 can be pulsed on and off of first squeegee roller 56 a number of times, as indicated by reference numeral 108, to remove an additional amount of developer liquid at each revolution of the squeegee roller. At the end of the complete process, first squeegee roller 56 is clean and ready for the next imaging sequence.

In a multi-color imaging system, the squeegee apparatus for removing excess developer liquid from photoreceptor 20, as described above, preferably is applied at each of development stations 12, 14, 16, 18 to eliminate each differently colored volume of excess developer liquid. Alternatively, the squeegee apparatus could be applied at a single location to remove developer liquid applied by each of development stations 12, 14, 16, 18. The apparatus overcomes the problems that can occur in existing imaging systems due to excess developer liquid. Specifically, the apparatus of the present invention prevents significant cross contamination of differently colored developer liquids due to formation of excess developer liquid. Further, the apparatus avoids the accumulation of excessive developer liquid volumes on the photoreceptor that can contaminate the image being formed. The problems of incomplete image transfer from the photoreceptor and image staining are thereby mitigated. In addition, the apparatus prevents the contamination of internal components of the imaging system, and thereby reduce the frequency of vigorous cleaning cycles. The apparatus also enables excess developer liquid to be reused, increasing the number of images that can be formed for a given volume of developer liquid.

Image quality, developer consumption, and developer contamination concerns are also raised by the passage of excess developer liquid to the downstream side of first squeegee roller 56, a problem sometimes referred to as "developer liquid wrap-around." The wrap-around developer liquid is undesirable because it can produce excess developer liquid in the margins of the printed page, adversely affecting image quality. The wrap-around developer liquid also can result in contamination of differently colored developer liquids and components within multicolor imaging system 10. Further, the wrap-around developer liquid cannot be reclaimed for use by imaging system 10, resulting in excessive developer liquid consumption.

Figure 10:
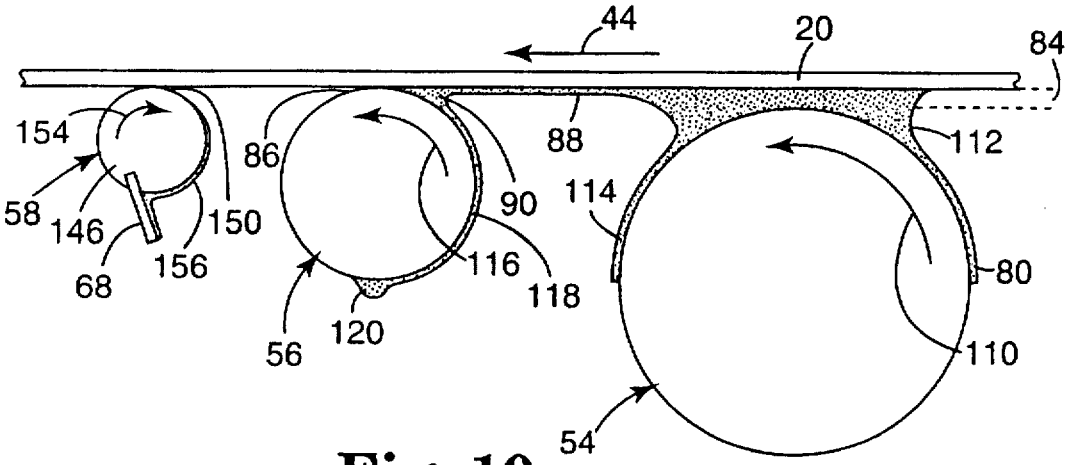
FIG. 10 is a side view of a portion of the imaging system of FIG. 1 incorporating a second squeegee apparatus for removing "wrap-around" developer liquid, in accordance with the present invention.

In accordance with the present invention, there is further provided a development apparatus that incorporates means for removing from photoreceptor 20 the excess developer liquid caused by developer liquid wrap-around. FIGS. 10–14 together illustrate an exemplary embodiment of such a development apparatus. FIG. 10 is a side view of a portion of imaging system 10 incorporating an exemplary embodiment of a squeegee apparatus, in accordance with the present invention. As shown in FIG. 10, the squeegee apparatus includes first squeegee roller 56, second squeegee roller 58, and second blade mechanism 68. In this exemplary embodiment, first squeegee roller 56 serves as a first developer liquid removal mechanism, whereas second squeegee roller 58 serves as a second developer liquid removal mechanism that removes wrap-around developer liquid from photoreceptor 20. The second blade mechanism 68 serves to remove excess developer liquid from second squeegee roller 58 to keep the outer surface of the second squeegee roller substantially clean and prevent developer liquid wrap-around on second squeegee roller 58. Instead of second blade mechanism 68, a rotating roller, belt, or vacuum device could be provided to keep second squeegee roller 58 clean.

In operation, as shown in FIG. 10, development roller 54 is positioned proximal to photoreceptor 20, forming gap 84. The thin, uniform layer 80 of developer liquid is applied at an upstream side of development roller 54 as the development roller is rotated in the same direction as photoreceptor 20, as indicated by arrow 110. The developer liquid is transferred from development roller 54 to photoreceptor 20, as indicated by reference numeral 112, to develop the latent image. A portion of the developer liquid remains on development roller 54 and is carried down the downstream side of the development roller, as indicated by reference numeral 114. Another portion of the developer liquid is transferred to photoreceptor 20, however, and carried downstream with the developed image to first squeegee roller 56, as indicated by reference numeral 88.

The first squeegee roller 56 is loaded against photoreceptor 20 to form nip 86. The first squeegee roller 56 is passively driven by frictional contact with the moving photoreceptor 20. Consequently, first squeegee roller 56 moves in the same direction of movement as photoreceptor 20, as indicated by arrow 116. As the region of photoreceptor 20 carrying the developed image encounters nip 86, first squeegee roller 56 removes a portion of excess developer liquid from the photoreceptor, serving to partially dry and film form the developer liquid remaining on photoreceptor 20 to facilitate transfer of the developed image. The excess developer liquid removed from photoreceptor 20 forms holdup volume 90 at the upstream side of nip 86 and first squeegee roller 56.

A balance between viscous forces and gravity forces determines the maximum amount of liquid in holdup volume 90. When holdup volume 90 has reached its maximum, any additional developer liquid entering the holdup volume results in liquid running down the upstream side of first squeegee roller 56, as indicated by reference numeral 118. The developer liquid running down the upstream side of first squeegee roller 56 accumulates in a drip volume 120 that drips into developer liquid recovery reservoir 60 for addition to the developer liquid supply of imaging system 10.

Figure 11:
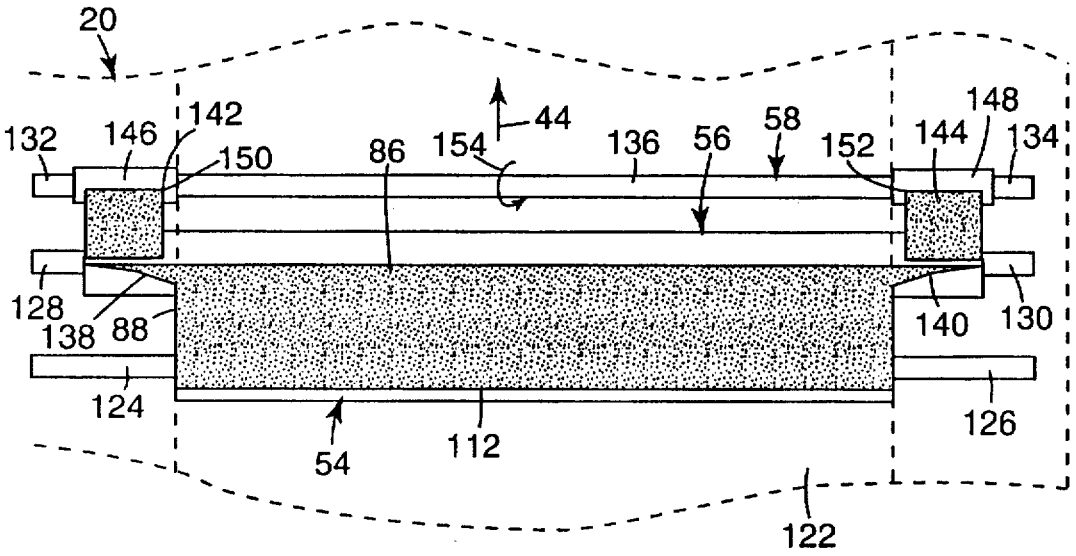
FIG. 11 is a top plan view of the second squeegee apparatus shown in FIG. 10.

FIG. 11 is a top plan view of the squeegee apparatus shown in FIG. 10. As shown in FIG. 11, development roller 54, first squeegee roller 56, and second squeegee roller 58 are positioned in sequence along an imaging region 122 of photoreceptor 20 in the direction of movement indicated by arrow 44. As further shown in FIG. 11, development roller 54 includes shaft ends 124, 126, first squeegee roller 56 includes shaft ends 128, 130, and second squeegee roller 58 includes shaft ends 132, 134, and central shaft section 136. The first squeegee roller 56 generally is effective in removing excess developer liquid from photoreceptor 20. However, the amount of developer liquid in hold-up volume 90 of the squeegee roller nip 86 can become excessive, leading to the developer liquid "wrap-around" problem, as illustrated by FIG. 11.

The developer liquid wrap-around problem is caused, in part, by forces in nip 86 that act to draw the developer liquid from holdup volume 90 laterally outward toward opposite ends of first squeegee roller 56. In FIG. 11, the lateral movement of the developer liquid is indicated by reference numerals 138, 140. As the imaging sequence progresses, the developer liquid reaches the dry end regions and is sucked, or "wrapped," around first squeegee roller 56 to the downstream side, as indicated by reference numerals 142, 144. The wrap-around developer liquid 142, 144 creates bands of liquid on the downstream side of first squeegee roller 56. The first squeegee roller 56 transfers the bands of liquid to photoreceptor 20. If left unchecked, wrap-around developer liquid 142, 144 can be carried downstream with photoreceptor 20.

Figure 12:
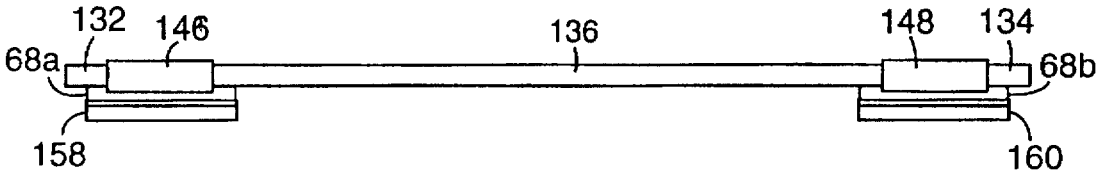
FIG. 12 is a front view of a squeegee roller forming part of a second squeegee apparatus, in accordance with the present invention.

The second squeegee roller 58 serves as a second developer liquid removal mechanism that removes wraparound developer liquid 142, 144 from photoreceptor 20, in accordance with the present invention. FIG. 12 is a front view of second squeegee roller 58, in accordance with the present invention. As shown in FIGS. 11 and 12, second squeegee roller 58 may include a first squeegee section 146 and a second squeegee section 148 mounted about common shaft 136. The first and second squeegee sections 146, 148 may comprise an elastomeric material such as polyurethane or nitrile, for example, mounted about rigid core sections on shaft 136. The first squeegee section 146 is mounted adjacent shaft end 132 and second squeegee section 148 is mounted adjacent shaft end 134. The second squeegee roller 58 is mounted at a position adjacent a downstream side of first squeegee roller 56.

The first squeegee section 146 and second squeegee section 148 are lightly loaded against photoreceptor 20 to make intimate contact with the photoreceptor, forming nips 150, 152. The first squeegee section 146 and second squeegee section 148 need only interfere with the surface of photoreceptor 20 to remove the wrap-around developer liquid. As with first squeegee roller 56, shaft ends 132, 134 of second squeegee roller 58 can be mounted in bearing mounts, and loaded against photoreceptor 20 with a loading means such as a spring loading mechanism. In addition, a camming or gear-driven mechanism can be provided to move second squeegee roller 58 in and out of proximity with photoreceptor 20. The first squeegee roller 56 and second squeegee roller 58 can be loaded against photoreceptor 20 with the same loading means. In this case, second squeegee roller 58 could be mounted in a fixed relationship with first squeegee roller 56, eliminating the need for a separate spring loading mechanism for the second squeegee roller.

A drive mechanism can be coupled to either of shaft ends 132, 134. The drive mechanism drives second squeegee roller 58 in a direction opposite to the direction of movement of photoreceptor 20, as indicated by arrow 154. The drive mechanism may comprise, for example, a motor or a belt or gear transmitting rotational force from a motor. The reverse operation of second squeegee roller 58 enables first squeegee section 146 and second squeegee section 148 to remove wrap-around developer liquid 142, 144, respectively, from photoreceptor 20 and carry the wrap-around developer liquid downward, as indicated by reference numeral 156 in FIG. 10. The first and second squeegee sections 146, 148 preferably are positioned slightly outside of imaging region 122. If first and second squeegee sections 146, 148 were positioned inside imaging region 122, the reverse operation of the squeegee sections could scrape away portions of developer liquid forming the developed image, significantly degrading image quality.

A loading force of approximately 0.5 kilograms, for example, applied to each of shaft ends 132, 134 has been observed to provide effective developer liquid removal during movement of second squeegee roller 58 in the direction indicated by arrow 154. Effective developer liquid removal likely can be carried out with less loading force or more loading force applied to second squeegee roller 58. However, excessive loading force may produce excessive wear on the release layer of photoreceptor 20 and may make first squeegee roller 56 more difficult to drive. The rate at which the developer liquid can be removed from photoreceptor 20 is generally a function of the velocity ratio of the photoreceptor surface to the surfaces of first and second squeegee sections 146, 148, the length of the first and second squeegee sections, and the diameter of the first and second squeegee sections. The developer liquid removal rate also may depend on the surface characteristics of the material forming first and second squeegee sections 146, 148 and the fluid characteristics of the developer liquid.

As an example, if first and second squeegee sections 146, 148 having an outer Nitrile layer of approximately 50 to 60 durometer Shore A, a diameter of approximately 1.0 centimeters, and a length of approximately 3.2 centimeters, are driven in direction 154 at approximately 5.1 centimeters per second, and loaded against photoreceptor 20 moving in first direction 44 at approximately 7.6 centimeters per second with a loading force of approximately 0.3 to 0.7 kilograms applied at each of shaft ends 132, 134, adequate removal of wrap-around developer liquid from the surface of the photoreceptor can be expected.

Figure 13:
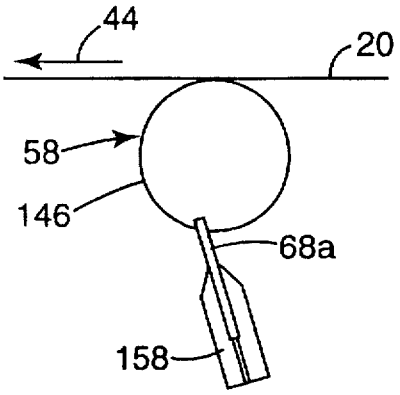
FIG. 13 is a side view of the squeegee roller shown in FIG. 12.
Figure 14:
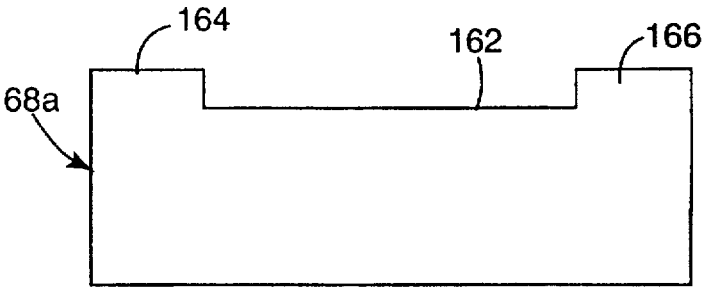
FIG. 14 is a front view of a portion of a blade for cleaning the squeegee roller shown in FIG. 12.

The developer liquid 156 carried downward by first squeegee section 146 and second squeegee section 148 can be removed by second blade mechanism 68. The developer liquid removed by second blade mechanism 68 can be incorporated into developer liquid recovery reservoir 60 for reintroduction into the developer liquid supply of imaging system 10. The second blade mechanism 68 keeps the outer surfaces of first and second squeegee sections 146, 148 clean for continued removal of wrap-around developer liquid from photoreceptor 20. The incorporation of second blade mechanism 68 is important in maintaining the developer liquid removal rate of first and second squeegee sections 146, 148 over an extended period of time. FIGS. 12–14 further illustrate second blade mechanism 68. FIG. 13 is a side view of second squeegee roller 58 with second blade mechanism 68. As shown in FIG. 12, for example, second blade mechanism 68 may comprise a first blade member **68*a* mounted to remove developer liquid from first squeegee section 146 and a second blade member 68*b* mounted to remove developer liquid from second squeegee section 148. With reference to FIGS. 12 and 13, first blade member 68*a* is positioned in a blade mount 158. Similarly, with reference to FIG. 12, second blade member 68*b* is positioned in a blade mount 160. The blade members 68*a*, 68*b* are mounted to extend along first and second squeegee sections 146, 148 in a trailing mode in the direction 154 of rotation of second squeegee roller 58**.

FIG. 14 is a front view of blade member **68*a* of FIG. 12. The blade members 68*a*, 68*b* provide first and second squeegee sections 146, 148 with clean surfaces for removal of additional developer liquid from photoreceptor 20 in the next revolution of second squeegee roller 58. Thus, blade members 68*a*, 68*b* enhance the ability of second squeegee roller 58 to remove excess developer liquid from photoreceptor 20. The blade members 68*a*, 68*b* should maintain uniform contact pressure across the entire lateral width of first and second squeegee sections 146, 148, respectively. Thus, blade members 68*a*, 68*b* preferably are made of a material selected so as to avoid warping or swelling. In particular, blade members 68*a*, 68*b* preferably comprise an elastomeric material for providing uniform contact pressure with first and second squeegee sections 146, 148, respectively. The blade members 68*a*, 68*b* also should be chemically inert to the developer liquid removed from second squeegee roller 58. As with first blade mechanism 66, an example of a suitable material for forming blade members 68*a*, 68*b*** is fluoroelastomer FC 2174, available from Minnesota Mining & Manufacturing Company ("3M") of St. Paul, Minn.

To avoid the possibility of a secondary developer liquid wrap-around occurring at the nips created by contact of squeegee sections 146, 148 and blade members **68*a*, 68*b*, respectively, the blade members preferably are formed to extend upward along both ends of the squeegee section. As shown in FIG. 14, for example, blade member 68*a* includes a cut-out section 162 and end sections 164, 166. The cut-out section 162 makes contact with the outer circumferential surface of first squeegee section 146 to remove developer liquid from the first squeegee section. The end sections 164, 166 extend upward and make contact with the ends of first squeegee section 146 to prevent lateral movement of developer liquid out of the nip formed between the first squeegee section and cut-out section 162. The blade member 68*a* thereby prevents secondary wrap-around of developer liquid from the blade member back to the ends of first squeegee section 146**.

Image quality concerns are further raised by nonuniform loading force along the length of first squeegee roller 56. Nonuniform loading force results in nonuniform pressure along the nip formed between first squeegee roller 56 and photoreceptor 20. Due to the nonuniform pressure, first squeegee roller 56 removes excess developer liquid from photoreceptor 20 in a nonuniform manner along the width of a developed image. The nonuniformity can result in visible nonuniformities in the developed image, degrading image quality in the ultimate printed image.

In accordance with the present invention, there is further provided a development apparatus incorporating a first squeegee roller 56 that achieves substantially uniform loading force along the length of the squeegee roller, and thus along the width of the imaging region of photoreceptor 20. As a result, the squeegee apparatus provides substantially uniform nip pressure, and substantially uniform removal of excess developer liquid from the photoreceptor. The uniform removal of excess developer liquid from the photoreceptor enhances the uniformity of the developed image and the quality of the printed image.

Figure 15:
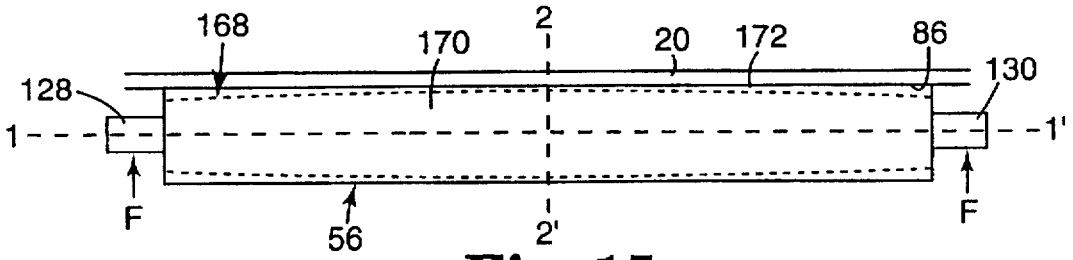
FIG. 15 is a diagram of a squeegee roller with a core profile, in accordance with the present invention.

FIG. 15 is a diagram of first squeegee roller 56 forming part of a squeegee apparatus capable of achieve substantially uniform nip pressure, in accordance with the present invention. As shown in FIG. 15, first squeegee roller 56 has a shaft 168 having a central longitudinal axis A–A'. The shaft 168 has first end 128, second end 130, and a core 170 extending between the first end and the second end along central longitudinal axis A–A'. The first end 128, second end 130, and core 170 are concentric about longitudinal axis A–A'. Elastomeric material 172 is formed about core 170. The core 170 has a cross-sectional area oriented perpendicular to longitudinal axis A–A' that varies along the longitudinal axis. As will be explained, the varying cross-sectional area of core 170, in part, enables first squeegee roller 56 to distribute loading force in a substantially uniform manner along its length.

The first squeegee roller 56 can be mounted within or adjacent to each of development stations 12, 14, 16, 18 in imaging system 10 of FIG. 1. A loading mechanism can be provided to apply a loading force F to each of first end 128 and second end 130. The loading force F is oriented to load core 170 of first squeegee roller 56 against photoreceptor 20, thereby forming pressure nip 86 between elastomeric material 172 and the photoreceptor. A backup roller or fixed backup shoe can be provided on a side of photoreceptor 20 opposite first squeegee roller 56 to provide support at nip 86. The loading mechanism can be applied to bearing mounts in which the first end 128 and second end 130 can be mounted. The bearing mounts enable shaft 168 to rotate about longitudinal axis A–A' in response to frictional force generated by contact with photoreceptor 20. In this manner, first squeegee roller 56 rotates in the same direction as photoreceptor 20, providing a holdup volume of developer liquid on the upstream side of nip 86.

The cross-sectional area of core 170, oriented perpendicular to longitudinal axis A–A', preferably is substantially circular. Thus, the circular cross-sectional area of core 170 has a diameter that varies along longitudinal axis A"A'. The core 170 preferably has a "crowned" profile such that the diameter of the cross-sectional area is maximum at a midpoint B–B' of the core along the longitudinal axis A–A'. In accordance with the present invention, the cross-sectional area of core 170 and the loading force F applied to each of first end 128 and second end 130 are selected to produce a substantially uniform pressure along nip 86. The substantially uniform pressure provided by first squeegee roller 56 along nip 86 thereby removes excess developer liquid from photoreceptor 20 in a substantially uniform manner, resulting in significantly enhanced image quality in the developed image and the ultimate printed image.

The force at midpoint B–B' of a right circular cylindrical core would be less than the force at opposite ends of the core due to axial deflection of shaft 168 in response to force applied to the ends. By varying the diameter of core 170 such that the diameter has a maximum at midpoint B–B', the force at the midpoint can be made substantially equivalent to the force at opposite ends of the core. The increasing diameter of core 170 as it approaches midpoint B–B' results in a more uniform force distribution along pressure nip 86. If the diameter of core 170 is made to continuously vary from one end to the other end with the maximum diameter occurring at midpoint B–B', the resultant force distribution can be rendered constant at some specific force F applied to first end 128 and second end 130. The specific force F sufficient to produce a constant force distribution along nip 86 will depend not only on the profile of core 170, however, but also on the modulus of shaft 168, the length of the shaft, the modulus of elastomeric material 172, and the thickness of the elastomeric material. Given selection of the above parameters, one can theoretically calculate a loading force F sufficient to achieve substantially uniform pressure along nip 86. Alternatively, the loading force sufficient to achieve substantially uniform pressure along nip 86 also can be determined by experimentation.

Figure 16:
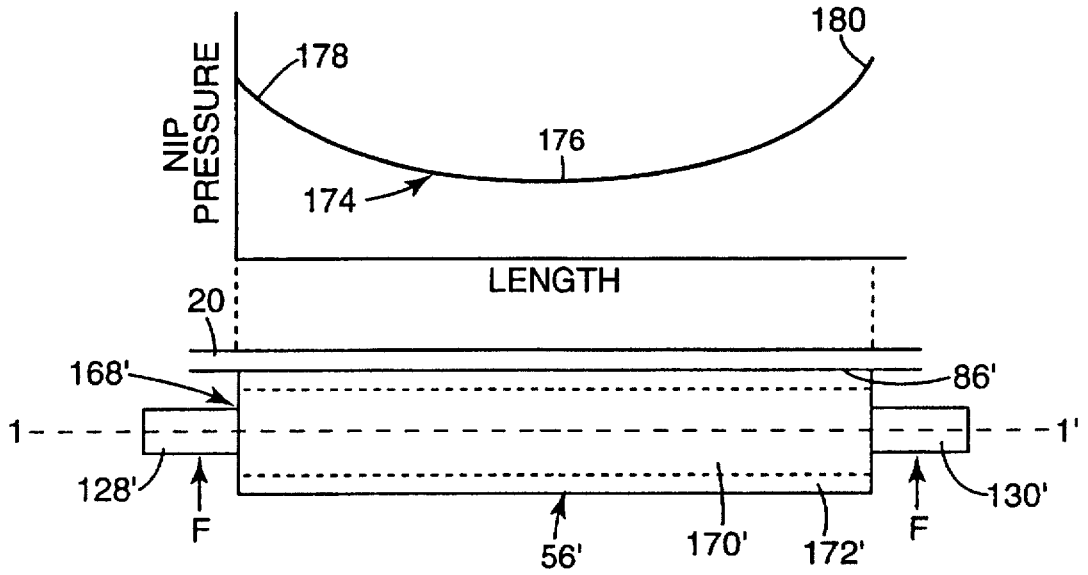
FIG. 16 is a diagram of an existing squeegee roller with a graph conceptually illustrating the loading force along the squeegee roller.

FIG. 16 is a diagram of an existing first squeegee roller 56' with a graph conceptually illustrating the loading force along the existing squeegee roller. As shown in FIG. 16, first squeegee roller 56' has a cylindrical core 170' that does not vary in diameter along longitudinal axis A–A'. Thus, with a loading force F applied to each of first end 128' and second end 130', first squeegee roller 56' produces a nonuniform distribution of loading force along nip 86'. In particular, curve 174 of the graph of FIG. 16 shows that loading pressure is significantly less at a midpoint 176 of core 170' than at opposite ends 178, 180 of the core. The reduced loading force toward midpoint 176 of core 170' results in nonuniform removal of developer liquid along the width of photoreceptor 20. Consequently, the developed image can be more wet in the center than at the edges. The wet areas can adversely affect the transfer of the developed image to intermediate rollers and the ultimate printing substrate, degrading image quality.

Figure 17:
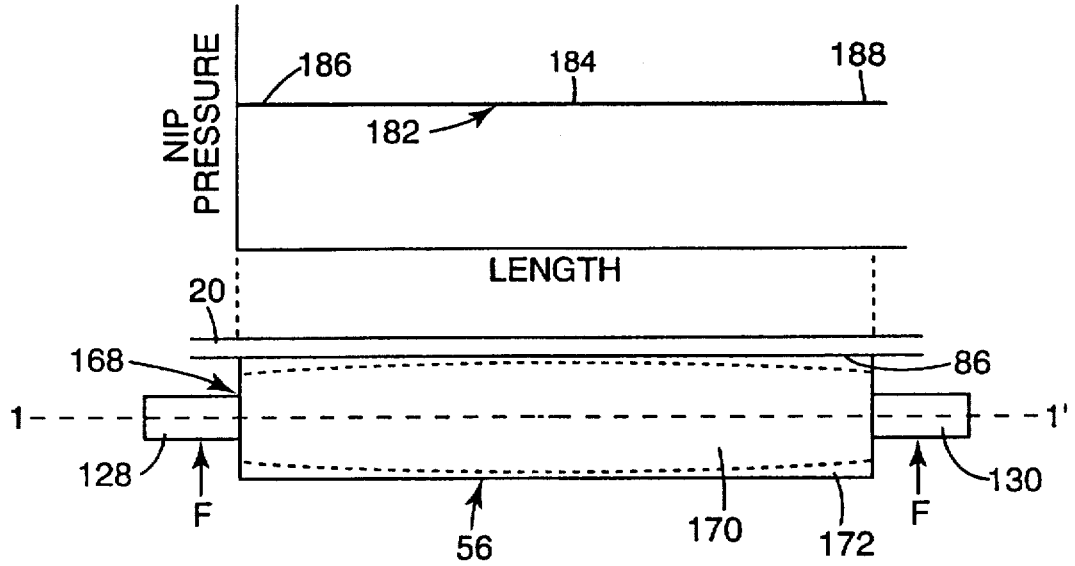
FIG. 17 is a diagram of the squeegee roller of FIG. 15 with a graph conceptually illustrating the loading force along the squeegee roller.

FIG. 17 is a diagram of first squeegee roller 56 of FIG. 15 with a graph conceptually illustrating the loading force along the squeegee roller. As shown in FIG. 17 and described above with reference to FIG. 15, first squeegee roller 56 has a core 170 that varies in diameter along longitudinal axis A–A', in accordance with the present invention. Thus, with a loading force F applied to each of first end 128 and second end 130, first squeegee roller 56 produces a more uniform distribution of loading force along nip 86. In particular, curve 182 of the graph of FIG. 17 shows that loading pressure is substantially constant along core 170, including midpoint 184 and opposite ends 186, 188. The constant loading force along core 170 results in uniform removal of developer liquid along the width of photoreceptor 20, enhancing image quality.

Figure 18:
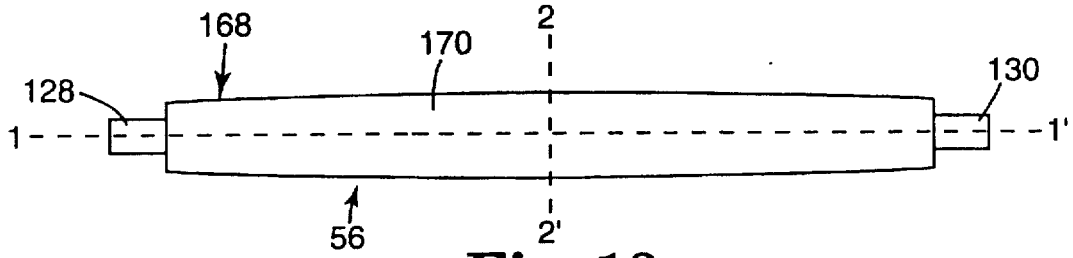
FIG. 18 is a diagram of the shaft and core of the squeegee roller of FIG. 15.

FIG. 18 is a diagram of shaft 168 of first squeegee roller 56 of FIG. 15, with core 170 and first and second ends 128, 130, prior to formation of elastomeric material 172. The shaft 168 can be formed from metal or from a substantially rigid non-metal such as, for example, a rigid plastic. Examples of suitable materials for formation of shaft 168 include steel, aluminum, stainless steel, polystyrene, poly vinyl chloride, polycarbonate, acetyl, and carbon-filled fiber glass. The metal or non-metal shaft 168 can be machined to define first end 128, second end 130, and core 170. For ease of manufacturing, however, shaft 168 preferably is cast in a mold to define first end 128, second end 130, and core 170, particularly if the shaft is made of plastic. Although the crowned profile of core 170 can be formed by machining, molding facilitates this operation.

Figure 19:
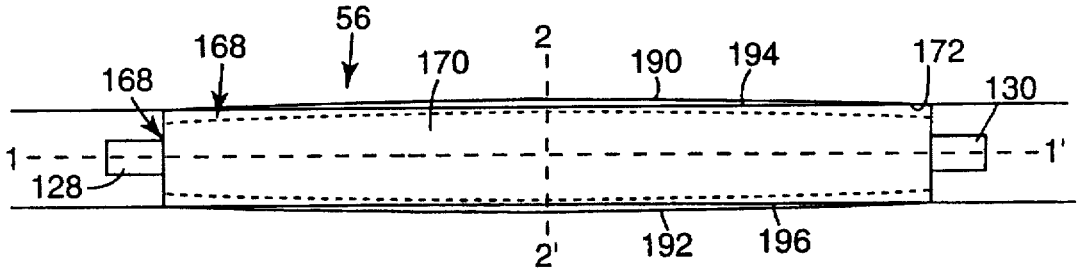
FIG. 19 is a diagram of the squeegee roller of FIG. 15 after formation of an elastomeric material about the core of the shaft shown in FIG. 18.

FIG. 19 is a diagram of first squeegee roller 56 of FIG. 15 after formation of elastomeric material 172 about core 170 shown in FIG. 18. Deformation of elastomeric material 172 in response to contact with photoreceptor 20 enables first squeegee roller 56 to conform to photoreceptor 20, enhancing uniformity of pressure along nip 86 relative to non-elastomeric materials. The elastomeric material 172 may comprise any of a variety of materials capable of resilient deformation such as, for example, polyurethane, nitrile, neoprene, natural rubber, or synthetic rubber. For uniform developer liquid removal, elastomeric material 172 has a durometer in the range of 10 to 90 Shore A, and preferably in the range of 50 to 70 Shore A. The elastomeric material 172 can be formed about core 170 by placing at least a portion of shaft 168 into a mold. The elastomeric material, in liquid state, is injected into the mold, and allowed to set. The shaft 168, with a layer of elastomeric material 172 formed over core 170, then is removed from the mold to provide first squeegee roller 56.

For uniform developer liquid removal, the outer surface of elastomeric material 172 preferably has a consistent texture. To avoid the formation of a parting seam on the surface of elastomeric material 172 upon removal from the mold, the elastomeric material can be formed over core 170 using a right circular cylindrical mold. The use of a right circular cylindrical mold allows first squeegee roller 56 to be removed from a circular opening at an end of the mold in a direction along the longitudinal axis A–A' of shaft 168, rather than by separating the mold along the surface of elastomeric material 172. The removal of first squeegee roller 56 from the end opening of the mold produces a seamless outer surface of elastomeric material 172.

The right circular cylindrical mold does not conform to the crowned profile of core 170. Thus, in the liquid state, the thickness of elastomeric material 172 extending radially outward from core 170 during molding generally will vary along the length of the core, with the thickness being least at the midpoint and greatest at the ends. After elastomeric material 172 has been removed from the mold and allowed to cool, the elastomeric material will assume a crowned profile. The elastomeric material 172 tends to shrink during cooling in proportion to its thickness in the liquid state. Therefore, the thickest regions of elastomeric material 172 will undergo the most shrinkage resulting in a substantially crowned contour about crowned core 170, as shown in FIG. 19. The crowned contour of elastomeric material 172 can be retained. If the crowned contour of shrinkage material 172 is retained, the elastomeric material and core 170 together will have a cross-sectional area oriented perpendicular to longitudinal axis A–A' that varies along the longitudinal axis, as indicated by contour lines 190, 192 in FIG. 19. Alternatively, the elastomeric material can be subjected to a post-mold surface processing operation, such as grinding, for example, to impart a texture to the surface of elastomeric material 172. The surface of elastomeric material 172 can be processed to a crowned profile or to a right circular cylindrical profile. Grinding to a cylindrical profile generally is less difficult than grinding to a non-cylindrical profile and improves repeatability. If the crowned contour of elastomeric material 172 is removed by surface processing to form a right circular cylinder, for example, the elastomeric material and core 68 together will have a cross-sectional area oriented perpendicular to longitudinal axis A–A' that remains substantially constant along the longitudinal axis, as indicated by lines 194, 196 in FIG. 19.

As an alternative to a right circular cylindrical mold with an end opening, elastomeric material 172 can be formed about core 170 using a right circular cylindrical clam-shell mold, or a clam-shell mold shaped to impart a crowned profile to elastomeric material 172. The clam-shell mold can have first and second pieces that are separated to remove elastomeric material 172 and core 170. The clam-shell mold will leave parting seams on elastomeric material 172. In addition, the crowned profile of elastomeric material 172 may be somewhat difficult to repeat. The parting seams can be removed by a post-mold surface processing operation, such as grinding. The surface processing operation also can be used to form elastomeric material 172 to a desired profile and diameter.

Image quality and maintenance concerns are raised by the accumulation of back-plated developer on the surface of development roller 54. The accumulation of back-plated developer can alter the development characteristics of development roller 54, resulting in inconsistent development of developer liquid on the surface of photoreceptor 20. Inconsistent development can require maintenance of development roller 54. Accordingly, it is desirable to provide an apparatus for removing the back-plated developer from development roller 54.

Figure 20:
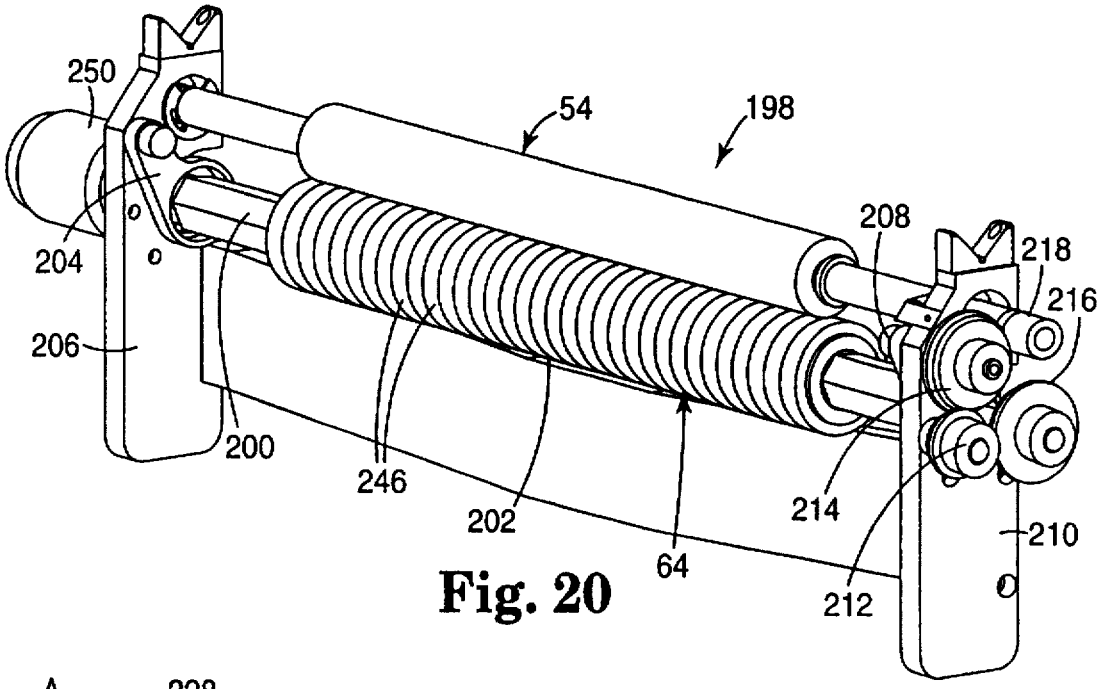
FIG. 20 is a perspective view of an apparatus for removing back-plated developer from a development device, in accordance with the present invention.

FIGS. 20–24 together illustrate an embodiment of an apparatus for removing back-plated developer from development roller 54, in accordance with the present invention. FIG. 20 is a perspective view of a developer sub-assembly 198 within one of development stations 12, 14, 16, 18. The development section 198 includes cleaning roller 64, which operates as part of a back-plated developer removal apparatus, in accordance with the present invention. The apparatus includes a shaft 200 and cleaning media 202 mounted about an outer surface of the shaft. The shaft 200 and cleaning media 202 together form cleaning roller 64. The shaft 200 includes a first end rotatably mounted in a first bearing mount 204 in a first bracket 206 and a second end rotatably mounted in a second bearing mount 208 in a second bracket 210. The development roller 54 similarly includes a shaft having a first end rotatably mounted in first bracket 206 and a second end rotatably mounted in second bracket 210. The first and second brackets 206, 210 can be mounted within a development station 12, 14, 16, 18 of liquid electrographic imaging system 10 of FIG. 1.

The cleaning roller 64 and development roller 54 are mounted adjacent one another such that cleaning media 202 is loaded against the outer surface of the development roller. The cleaning roller 64 can be loaded against development roller 54 with, for example, a spring mounting mechanism. Alternatively, cleaning roller 64 could be rigidly mounted to bear against development roller 54. A motor can be provided to simultaneously drive shaft 200 and the shaft of development roller 54 via gears 212, 214, 216, 218. For example, a motor can be coupled to a shaft on which gear 212 is mounted. The gear 212 can transmit rotational force from the motor to gears 214, 216, 218. The cleaning roller 64 and development roller 54 preferably are coupled to gears 212, 214, 216, 218 such that the cleaning roller is driven in a direction opposite to the development roller. In this manner, a difference in surface velocity between development roller 54 and cleaning roller 64 can be readily achieved. The cleaning roller 64 could be driven in the same direction as development roller 54, however, if the cleaning roller was geared at a higher or lower velocity.

Figure 21:
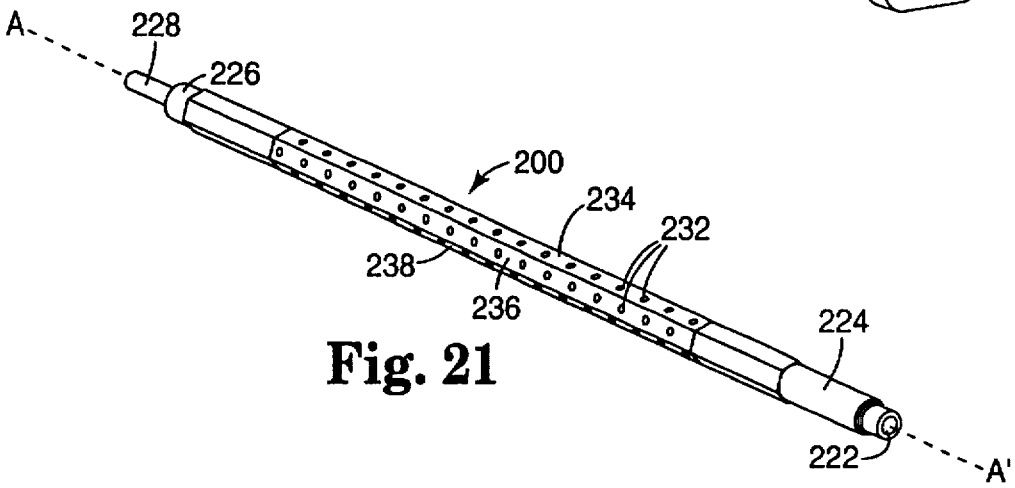
FIG. 21 is a perspective view of a shaft forming part of the apparatus shown in FIG. 20.
Figure 22:
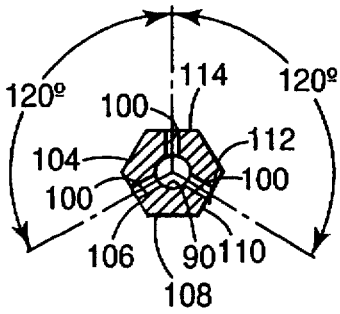
FIGS. 22 cross-sectional side view of the shaft shown in FIG. 21 taken along a first plane perpendicular longitudinal axis A–A'.
Figure 23:
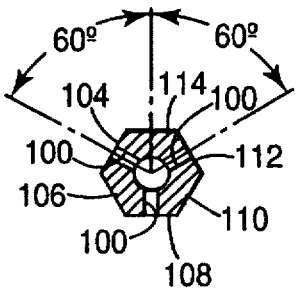
FIG. 23 is a cross-sectional side view of the shaft shown in FIG. 21 taken along a second plane perpendicular longitudinal axis A–A'.

FIG. 21 is a perspective view of shaft 200, in accordance with the present invention, without cleaning media 202. FIGS. 22 and 23 are cross-sectional views taken at different planes of shaft 200 perpendicular to longitudinal axis A–A'. As shown in FIGS. 22 and 23, shaft 200 includes a central fluid flow channel 220 extending along longitudinal axis A–A' of the shaft. FIG. 21 shows a bore 222 at first end 224 of shaft 200 leading to central fluid flow channel 220. The first end 224 of shaft 200 can be mounted in bearing mount 204 in first bracket 206. With further reference to FIG. 21, second end 226 of shaft 200 can be mounted in bearing mount 208 in second bracket 210 and coupled to gear 216 with a pin 228. As shown in FIGS. 22 and 23, shaft 200 also includes a plurality of radial fluid flow channels 230 extending radially outward from the central fluid flow channel to an outer surface of the shaft. As shown in FIG. 21, radial fluid flow channels 230 lead to apertures 232 formed in the outer surface of shaft 200.

The shaft 200, central fluid flow channel 220, radial fluid flow channels 230, and apertures 232 can be formed, for example, from machined metal or molded plastic. The shaft 200 can have a non-circular cross section, if desired. As shown in FIGS. 21, 22, and 23, for example, shaft 200 may have a hexagonal cross section. The hexagonal cross section produces an outer surface of shaft 200 having flat surfaces 234,236, 238, 240, 242, 244. Each of apertures 232 is formed in one of flat surfaces 234, 236, 238, 240, 242, 244. The radial fluid flow channels 230 can be distributed such that three radial fluid flow channels extend from a common portion of central fluid flow channel 220 at each of a plurality of positions along the length of shaft 200. The radial fluid flow channels 230 can terminate in apertures 232 formed in alternating flat surfaces 234, 236, 238, 240, 242, 244. For example, FIG. 22 shows one position along the length of shaft 200 at which radial fluid flow channels 230 lead to apertures 232 formed in alternating flat surfaces 236, 240, 244. At another position along the length of shaft 200, shown in FIG. 23, radial fluid flow channels 230 lead to apertures 232 formed in alternating flat surfaces 234, 238, 242.

The central fluid flow channel 220 receives a cleaning liquid via a rotary union assembly mounted about first end 224 of shaft 200, as will be described. The central fluid flow channel 220 delivers the cleaning liquid to radial fluid flow channels 230. The radial fluid flow channels 230 deliver the cleaning liquid to the outer surface of shaft 200 via apertures 232. The cleaning media 202 receives the cleaning liquid from radial fluid flow channels 230 and apertures 232. The cleaning media 202 is loaded against development roller 54 to remove back-plated developer from the development roller. The cleaning media 202 preferably comprises a resiliently compliant material. The resilient compliance enables cleaning media 202 to deflect and recover upon contact with development roller 54, producing a shear action that serves to effectively remove back-plated developer from the development roller. In particular, the shear action breaks up the back-plated developer "sludge" for redispersion into the developer liquid supply. The term "redispersion" refers to the operation of breaking up the back-plated developer sludge into smaller developer particles having substantially the same size as original developer particles in the developer liquid, and reintroducing the smaller developer particles into the carrier liquid. Redispersion enables recovery and reuse of the back-plated developer, thereby reducing developer liquid consumption. The resiliently compliant material of cleaning media 202 preferably is sufficiently porous to include a plurality of flow paths. The porosity enables cleaning media 202 to receive and transmit the cleaning liquid delivered by the radial fluid flow channels 230 of shaft 200. In particular, as cleaning media 202 removes developer from development roller 54, the cleaning liquid received from radial fluid flow channels 230 flushes the removed developer away via the flow paths in the cleaning media. Instead of feeding fluid through shaft 200, the apparatus could be modified to flush developer liquid from cleaning media 202 by alternative fluid flow means such as immersion of cleaning roller 64 in cleaning liquid or by curtain feeding cleaning liquid over the cleaning roller. In addition, it is conceivable that effective cleaning could be achieved for a period of time without providing fluid flow to flush developer liquid from cleaning media 202. In addition to being resiliently compliant and porous, the material ordinarily should be electrically insulative so as to avoid altering the charge on development roller 54, and chemically inert to the developer liquid used in imaging system 10.

As shown in FIG. 20, cleaning media 202 can be realized by a plurality of rings 246 of the resiliently compliant, porous material. The rings 246 are mounted adjacent one another along the length of shaft 200. The rings 246 can be compressed against one another such that substantially no gap exists between adjacent rings. In this manner, rings 246 effectively operate as a continuous cleaning media. The rings 246 can be made, for example, by punching circular discs from a sheet of the resiliently compliant, porous material, and then punching mounting apertures in the discs. The resulting rings 246 can be stacked along the length of shaft 200 such that the shaft extends through the mounting apertures of the rings. The hexagonal cross-section of shaft 200 helps to prevent free rotation of rings 246 about the shaft. As an alternative, cleaning media 202 can be realized by mounting a continuous sleeve of the resiliently compliant, porous material about shaft 200. As a further alternative, a continuous length of the resiliently compliant, porous material could be wrapped about the outer surface of shaft 200 in a tight helical pattern to form a substantially continuous cleaning media 202.

The resiliently compliant, porous material forming cleaning media 202 can be realized, for example, by an open-cell foam or a woven fabric material that enables the flow of cleaning liquid through holes in the material to flush away developer removed from development roller 54. The resiliently compliant, porous material forming cleaning media 202 preferably is realized, however, by a non-woven, air laid fiber material or by a non-woven blown micro fiber material. An example of a non-woven, air laid fiber material suitable for fabrication of cleaning media 202 is SCOTCHBRITE™ T-TALC material, commercially available from Minnesota Mining and Manufacturing Company (3M) of St. Paul, Minn. This air laid fiber material provides resilient compliance sufficient to deflect and recover upon contact with development roller 54. This air laid fiber material also is sufficiently porous to allow flow of cleaning liquid from apertures 232 to flush away back-plated developer removed from development roller 54.

The fiber material can provide a coarse cleaning media 202 that aids in scrubbing developer from development roller 54. In particular, if the fiber material is cut, such as by punching from a larger sheet, fiber bristles tend to be exposed at cleaning media 202. The fiber bristles can enhance the scrubbing action of cleaning media 202. The fiber material can be impregnated with abrasive material, if desired, for enhanced scrubbing. The use of an abrasive material ordinarily will be undesirable, however, in view of potential damage to development roller 54. Thus, the fiber material preferably is substantially non-abrasive. The rings 246 can be subjected to a surface grinding operation, if desired, to produce a uniform dimension about shaft 200 that approximates a right circular cylinder. The uniform dimension enhances uniformity of contact of rings 246 with development roller 54.

The cleaning liquid flowing through central fluid flow channel 220, radial fluid flow channels 230, and cleaning media 202 loosens developer removed from development roller 54 and flushes the developer from the cleaning media. The cleaning liquid can be realized by a solvent such as, for example, NORPAR or ISOPAR solvent, commercially available from Exxon. The cleaning liquid preferably is realized, however, by the developer liquid used by imaging system 10. Specifically, the cleaning liquid used by imaging system 10 may comprise developer particles dispersed in a carrier liquid such as NORPAR or ISOPAR solvent. The developer liquid can be pumped through central fluid flow channel 220, radial fluid flow channels 230, and cleaning media 202, and used to dislodge back-plated developer from cleaning roller 64. In a multi-color system, the developer liquid should be of the same color as the back-plated developer to avoid cross-contamination of colors. If developer recovery is not a concern, a solvent, by itself, could be used. The back-plated developer removed from development roller 54 is flushed into developer liquid recovery reservoir 60, shown in FIG. 1, by the developer liquid and reconstituted into the developer liquid supply for imaging system 10. The developer liquid tends to act like a solvent to the sludge-like back-plated developer particles. The flushing action of the developer liquid keeps cleaning media 202 substantially free of back-plated developer removed from development roller 54, thereby maintaining the cleaning efficiency of cleaning roller 64 for an extended period of time.

Figure 24:
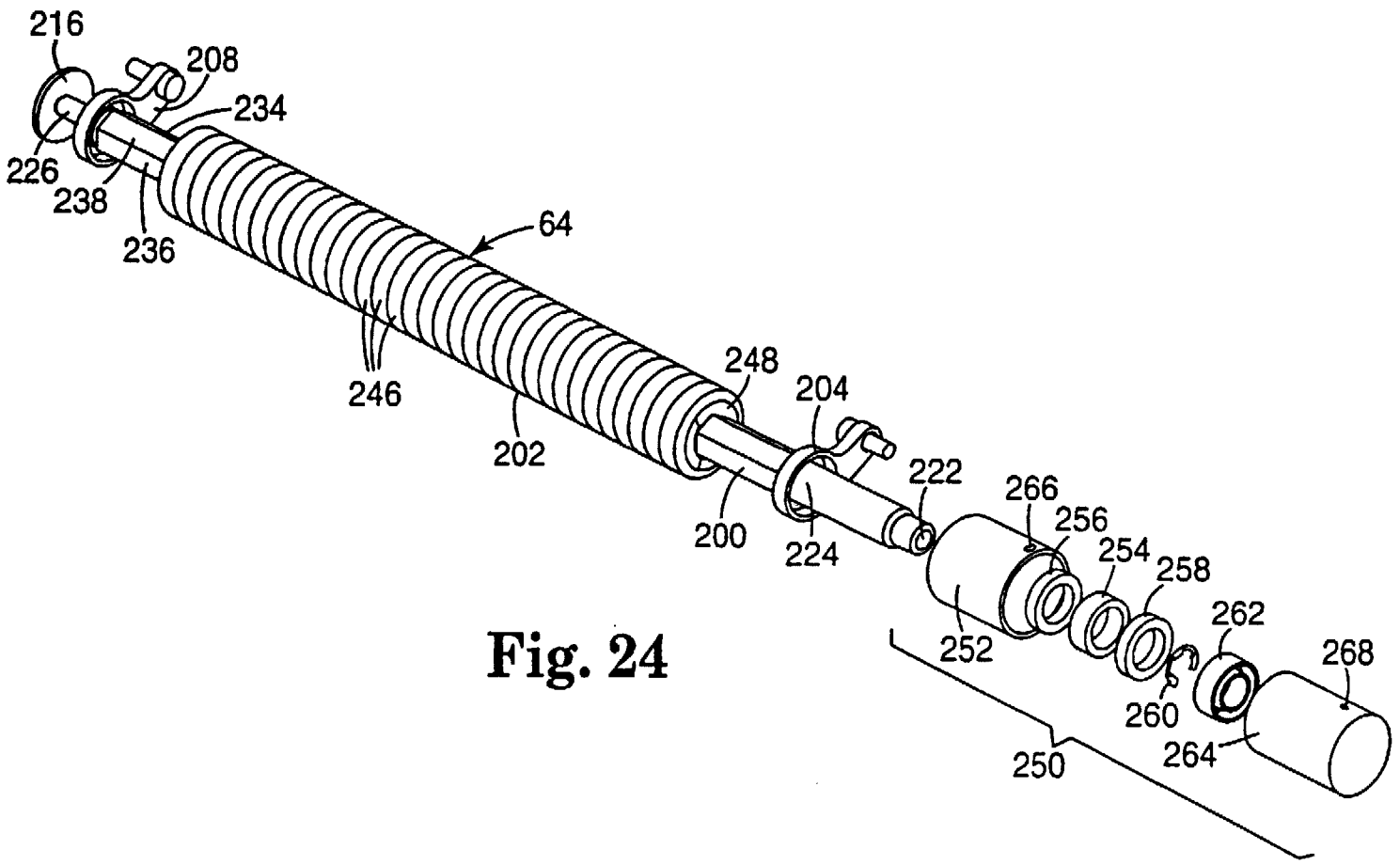
FIG. 24 is an exploded perspective view of part of the apparatus of FIG. 20, in accordance with the present invention.

FIG. 24 is an exploded perspective view of part of the apparatus of FIG. 21, in accordance with the present invention. FIG. 24 illustrates exemplary structure for mounting rings 246 on shaft 200 to form cleaning media 202, exemplary structure for mounting shaft 200 to first bracket 206 and to second bracket 210, and exemplary structure for transmitting cleaning liquid to central fluid flow channel 220 and radial fluid flow channels 230. The structure for mounting rings 246 on shaft 200 may include, for example, a pair of clips that compressively hold the rings together. FIG. 24 shows one clip 248. As shown in FIG. 24, first and second bearing mounts 204, 208 can be mounted to first and second brackets 206, 210. The first bearing mount 204 supports first end 224 of shaft 200, whereas second bearing mount 208 supports second end 226 of the shaft. The pin 228 formed at second end 226 of shaft 200 can be coupled to gear 216 to enable rotation of the shaft for cleaning operations.

The structure for transmitting cleaning liquid to central fluid flow channel 220, radial fluid flow channels 230, and ultimately cleaning media 202 may include a rotary union assembly 250. As shown in FIG. 24, rotary union assembly 250 may include a retainer housing 252, ring spacer 254, ball bearings 256 and 258, a clip 260, a seal 262, and rotational feed housing 264. The retainer housing 252 and rotational feed housing 264 are coupled to one another via a pair of screw holes 266, 268 and a screw, and together house ring spacer 254, ball bearings 256 and 258, clip 260, and seal 262. The first end 224 of shaft 200 extends through ring spacer 254, ball bearings 256 and 258, clip 260, and seal 262 such that bore 222 is accessible by an interior cavity of rotational feed housing 264. The shaft 200 is free to rotate within ring spacer 254, ball bearings 256 and 258, clip 260, and seal 262, in response to rotational force from gear 216. The retainer housing 252 and rotational feed housing 264 remain fixed.

An aperture (not shown) in rotational feed housing 264 is fitted with a fluid feed line. The fluid feed line is used to feed cleaning liquid, under pressure provided by an external pump, into the cavity of rotational feed housing 264. The cleaning liquid is thereby transmitted into bore 222, along central fluid flow channel 220, and to radial fluid flow channels 230. In this manner, the cleaning liquid is made to flow through the porous fiber material of cleaning media 202, flushing away back-plated developer removed from development roller. The pressure of the flow can be adjusted via the pump to achieve a desired flushing action within cleaning media 202. The flushing action dislodges the back-plated developer removed from development roller 54 for reconstitution into the developer liquid supply of imaging system 10.

Figure 25:
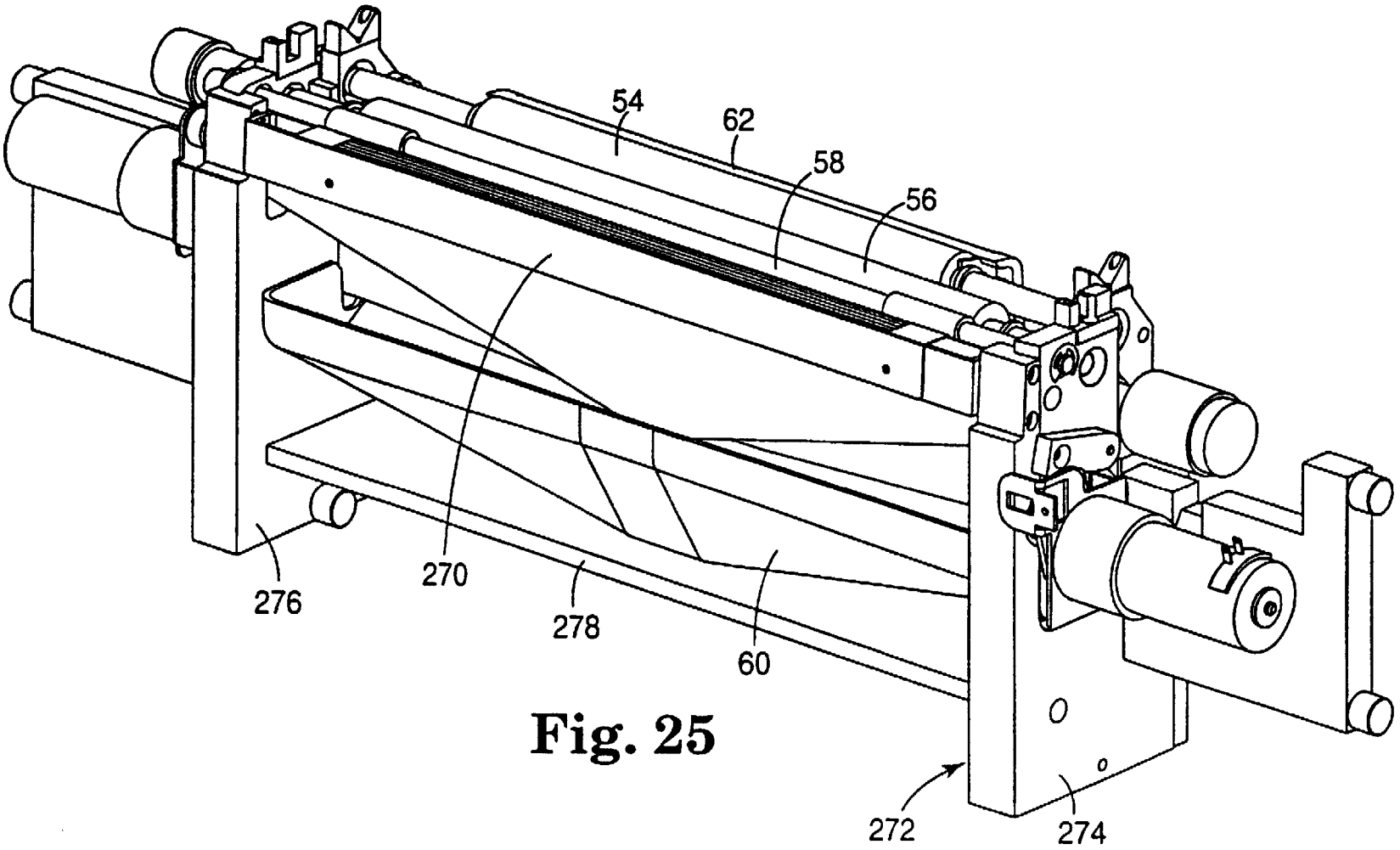
FIG. 25 is a perspective view of a development apparatus, in accordance with the present invention.

FIGS. 25–31 further illustrate an exemplary embodiment of a development apparatus, in accordance with the present invention. FIG. 25 is a perspective view of an overall development apparatus that can be used as a developer station 12, 14, 16, 18 in, for example, imaging system 10 of FIG. 1. As shown in FIG. 25, the development apparatus includes development roller 54, first squeegee roller 56, second squeegee roller 58, developer liquid recovery reservoir 60, and plenum 62. FIG. 25 does not show cleaning roller 64. FIG. 25 shows an optional corona sub-assembly 270. The development roller 54, first squeegee roller 56, second squeegee roller 58, reservoir 60, plenum 62, cleaning roller 64, and corona sub-assembly 270 and associated electrical and mechanical hardware can be mounted together in a common frame assembly 272 to form a development station. The frame assembly 272 may include a first side frame 274, a second side frame 276, and a cross member 278 extending between the first and second side frames.

Figure 26:
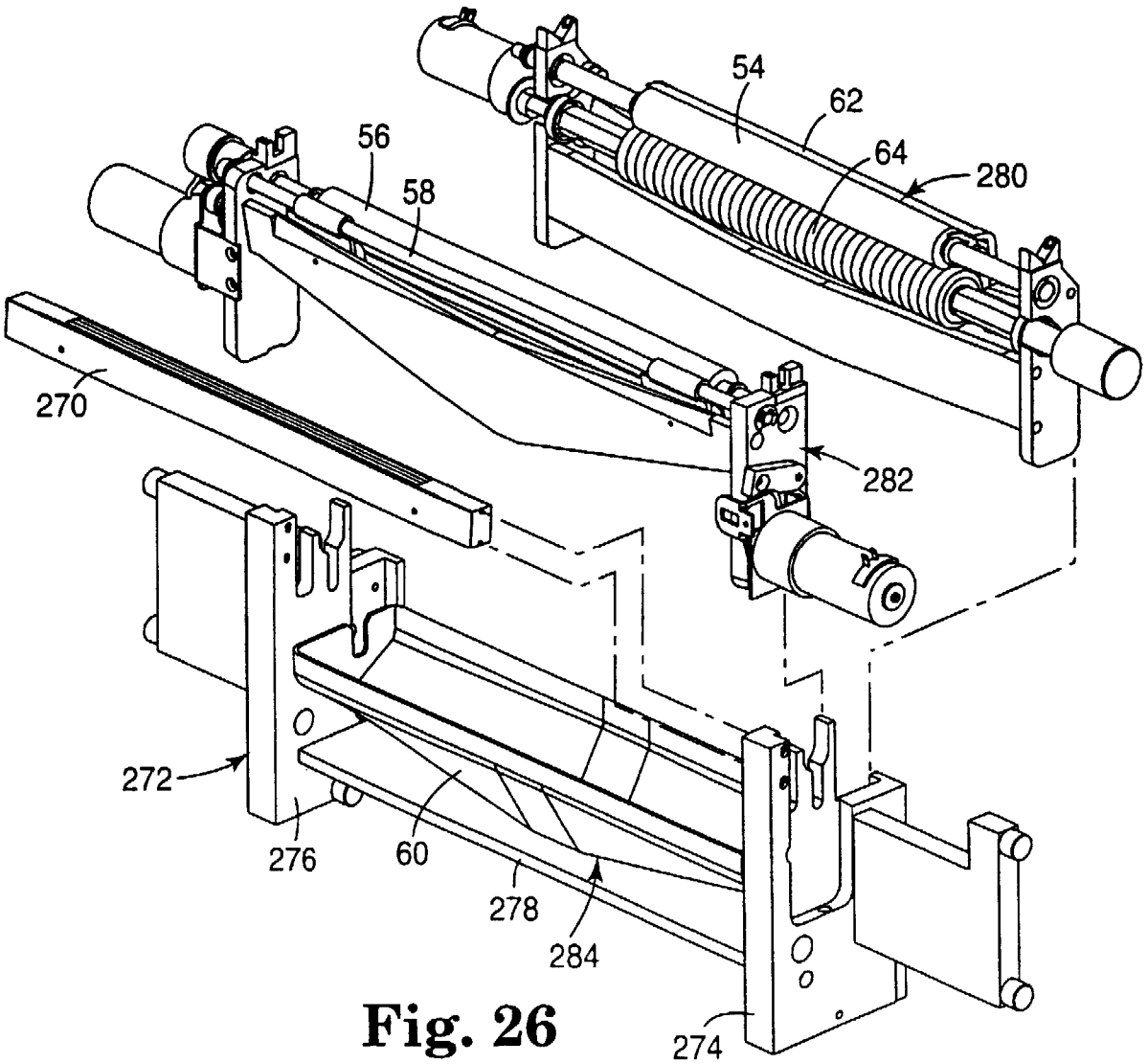
FIG. 26 is an exploded perspective view of the development apparatus of FIG. 25.

FIG. 26 is an exploded perspective view of the development apparatus of FIG. 25. As shown in FIG. 26, the development apparatus may be configured to include a developer sub-assembly 280, a squeegee sub-assembly 282, a developer liquid recovery sub-assembly 284, and corona sub-assembly 270. The developer sub-assembly 280 includes development roller 54, plenum 62, and cleaning roller 64. The squeegee sub-assembly 282 includes first squeegee roller 56 and second squeegee roller 58. The developer liquid recovery sub-assembly 284 includes reservoir 60.

Figure 27:
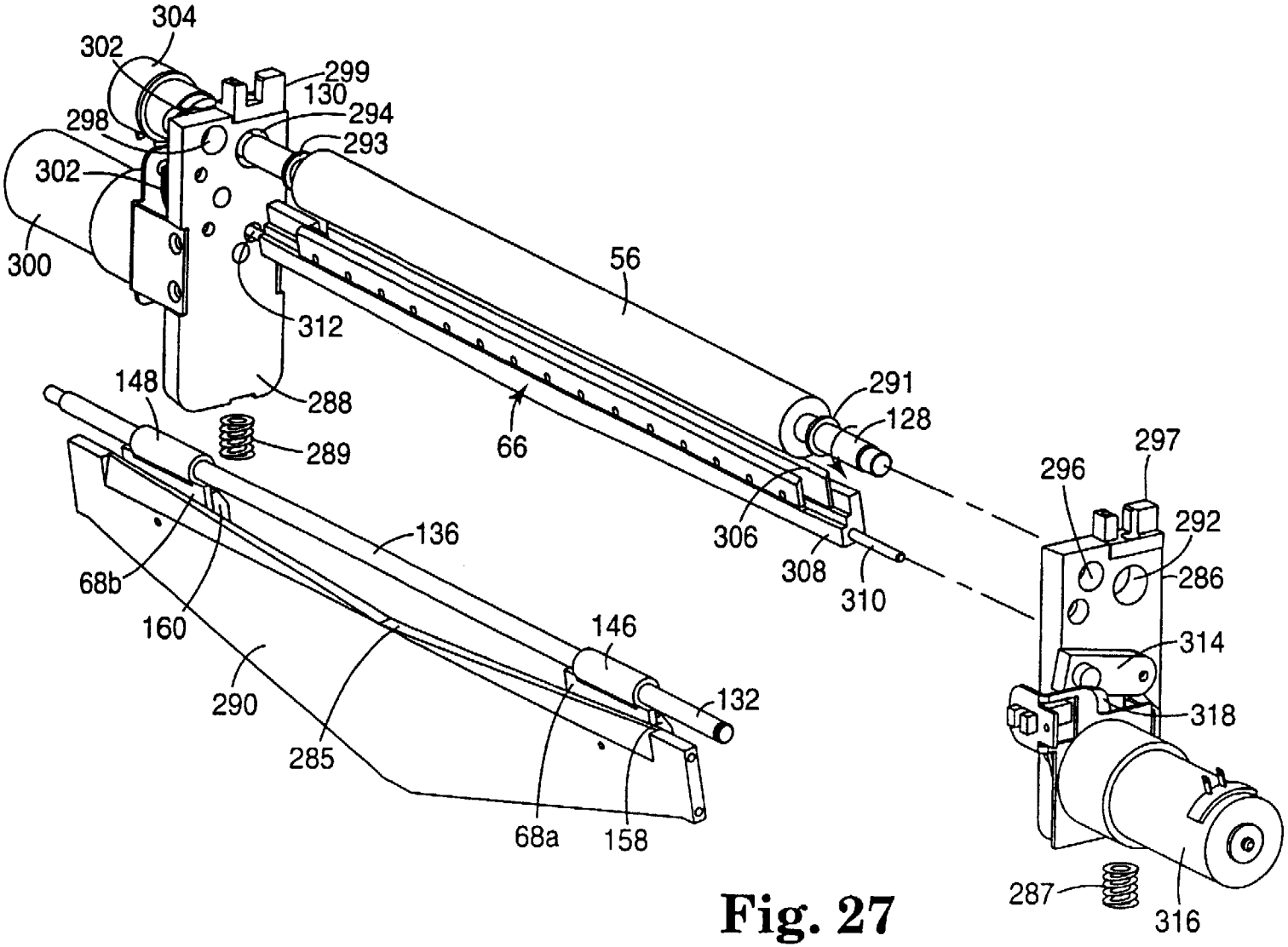
FIG. 27 is an exploded perspective view of a squeegee sub-assembly of the development apparatus of FIG. 25.

FIG. 27 is an exploded perspective view of squeegee sub-assembly 282 of the development apparatus of FIG. 25. In addition to first squeegee roller 56 and second squeegee roller 58, squeegee sub-assembly 282 includes a first side plate 286, a second side plate 288, and a cross member 290 that extends between the first and second side plates when assembled. As indicated by reference numeral 285, cross member 290 can be designed to slope downward toward the center of squeegee assembly 282. The sloping contour of cross member 290 causes developer liquid to drain downward toward reservoir 60, preventing lateral travel of the developer liquid. The first and second side plates 286, 288 are spring-loaded with springs 287, 289, respectively. The first and second ends 128, 130 of first squeegee roller 56 are rotatably mounted in apertures 292, 294 in first and second side plates 286, 288, respectively. Rings 291, 293 can be provided on first and second ends 128, 130, respectively, of first squeegee roller 56 to prevent the lateral travel of developer liquid. The first and second ends 132, 134 of second squeegee roller 58 are rotatably mounted in apertures 296, 298 in first and second side plates 286, 288, respectively.

Positioning blocks 297, 299 are provided on first and second side plates 286, 288 to capture the shafts of backup rollers on the opposite side of photoreceptor 20. The positioning blocks 297, 299 form part of a positioning mechanism to be further described with reference to FIG. 29. The positioning blocks 297, 299 enable controlled positioning of squeegee rollers 56, 58 against photoreceptor 20 and the backup rollers. In particular, positioning blocks 297, 299 control the orientation of squeegee rollers 56, 58 relative to the backup rollers along the length of photoreceptor 20. It is not necessary that positioning blocks 297, 299 contact the shafts of backup rollers. Rather, positioning blocks can be oriented to contact any fixed surface.

With further reference to FIG. 27, second end 134 of second squeegee roller 58 is coupled to a motor 300 via a series of gears 302 (partially shown in FIG. 27). The motor 300 drives second squeegee roller 58 in a direction opposite to photoconductor 20 on a full-time basis. The first and second squeegee sections 146, 148 are thereby rotated to remove "wrap-around" developer liquid, as described above with reference to FIGS. 10–14. First and second blade members 68*a*, 68*b* are mounted in blade mounts 158, 160 adjacent first and second squeegee sections 146, 148, respectively, to keep the squeegee sections clean of developer liquid. The blade mounts 158, 160 are mounted on cross member 290.

The second end 130 of first squeegee roller 56 is coupled to motor 300 via gears 302 and a clutch 304. The clutch 304 is activated to drive first squeegee roller 56 in a direction opposite to photoconductor 20 on a selective basis to remove "drip line" developer liquid, as described above with reference to FIGS. 2–9. The first blade mechanism 66 includes a blade member 306 mounted in a blade mount 308. A first end 310 of blade mount 308 is mounted in an aperture in first side plate 286. A second end 312 of blade mount 308 is mounted in an aperture in second side plate 288. The first end 310 of blade mount 308 extends through a free end of a pivoted lever 314 mounted on first side plate 286. A motor 316 actuates a cam 318 that moves lever 314 to control the cleaning operation of first blade mechanism 66 relative to first squeegee roller 56.

Figure 28:
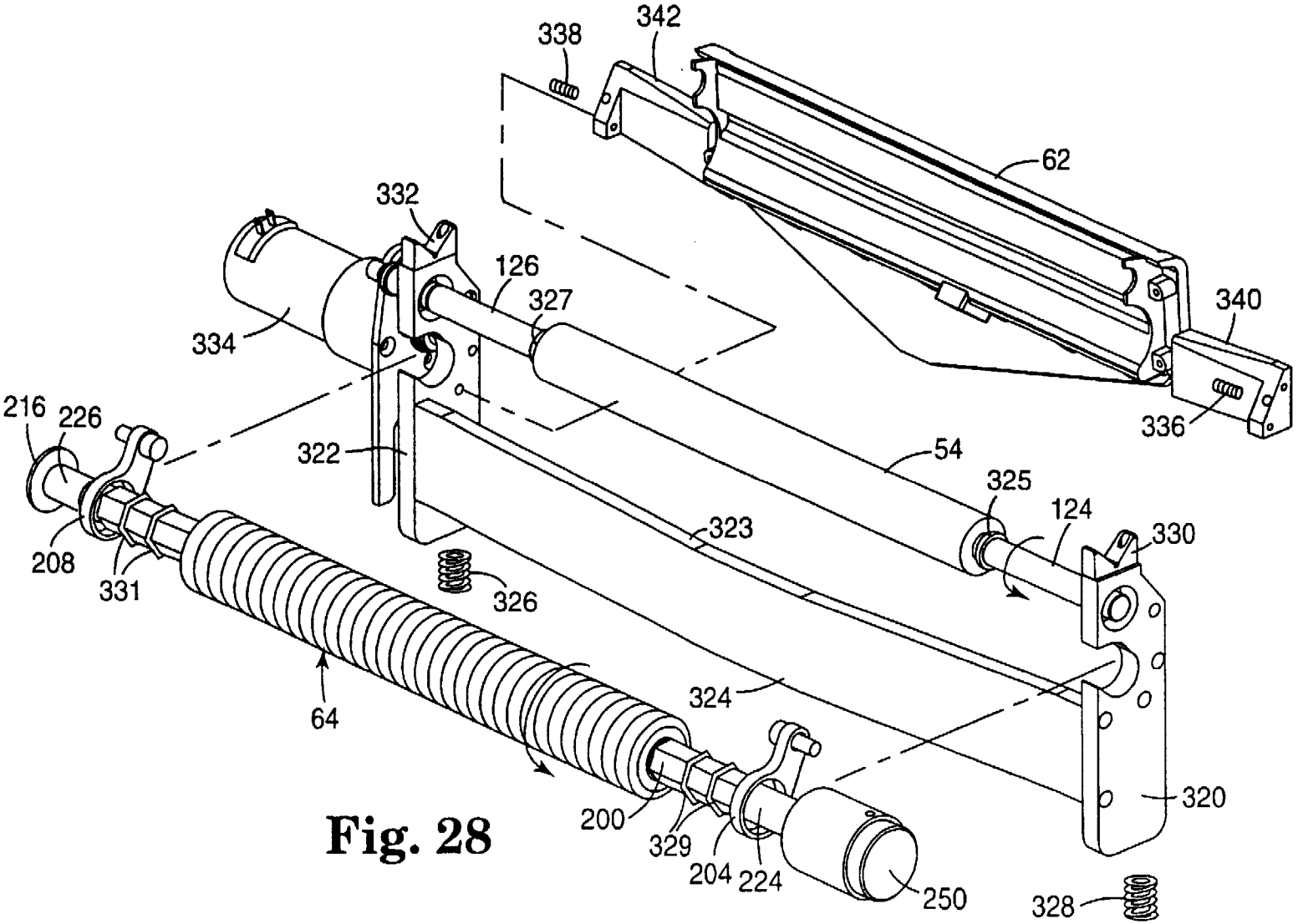
FIG. 28 is an exploded perspective view of a developer sub-assembly of the development apparatus of FIG. 25.

FIG. 28 is an exploded perspective view of developer sub-assembly 280 of the development apparatus of FIG. 25. In addition to development roller 54, plenum 62, and cleaning roller 64, developer sub-assembly 280 includes a first side plate 320, a second side plate 322, and a cross member 324 that extends between the first and second side plates when assembled. The cross member 324 can be designed to slope downward toward the center of developer assembly 280, as indicated by reference numeral 323, to prevent lateral travel of the developer liquid. In addition, as with squeegee sub-assembly 282, first and second side plates 320, 322 of developer sub-assembly 280 are spring-loaded with springs 326, 328 respectively. The first and second ends 124, 126 of development roller 54 are rotatably mounted in first and second side plates 320, 322, respectively. Rings 325, 327 can be provided on first and second ends 128, 130, respectively, of development roller 54 to prevent the lateral travel of developer liquid.

The first and second ends 224, 226 of cleaning roller 64 are mounted in bearing mounts 204, 208 mounted on first and second side plates 320, 322, respectively. Rings 329, 331 also can be provided on first and second ends 224, 226, respectively, of cleaning roller 64 to prevent the lateral travel of developer liquid. Positioning blocks 330, 332 are provided on first and second side plates 320, 322 to capture the shafts of backup rollers on the opposite side of photoreceptor 20 or to contact other fixed surfaces. Like positioning blocks 297, 299, blocks 330, 332 form part of a positioning mechanism to be further described with reference to FIG. 29. The positioning blocks 330, 332 enable controlled spacing between development roller 54 and photoreceptor 20 without the use of gapping wheels that could adversely affect the motion of the photoreceptor. As further shown in FIG. 28, second end 126 of development roller 54 is coupled to a motor 334 via a series of gears. The motor 334 drives development roller 54 in the same direction as photoreceptor 20 for delivery of developer liquid. The plenum 62 can be mounted to first and second side plates 320, 322 with screws 336, 338, respectively. The plenum 62 includes lateral surfaces that slope downward toward the center of developer sub-assembly 280, as indicated by reference numerals 340, 342, to prevent lateral travel of developer liquid.

Figure 29:
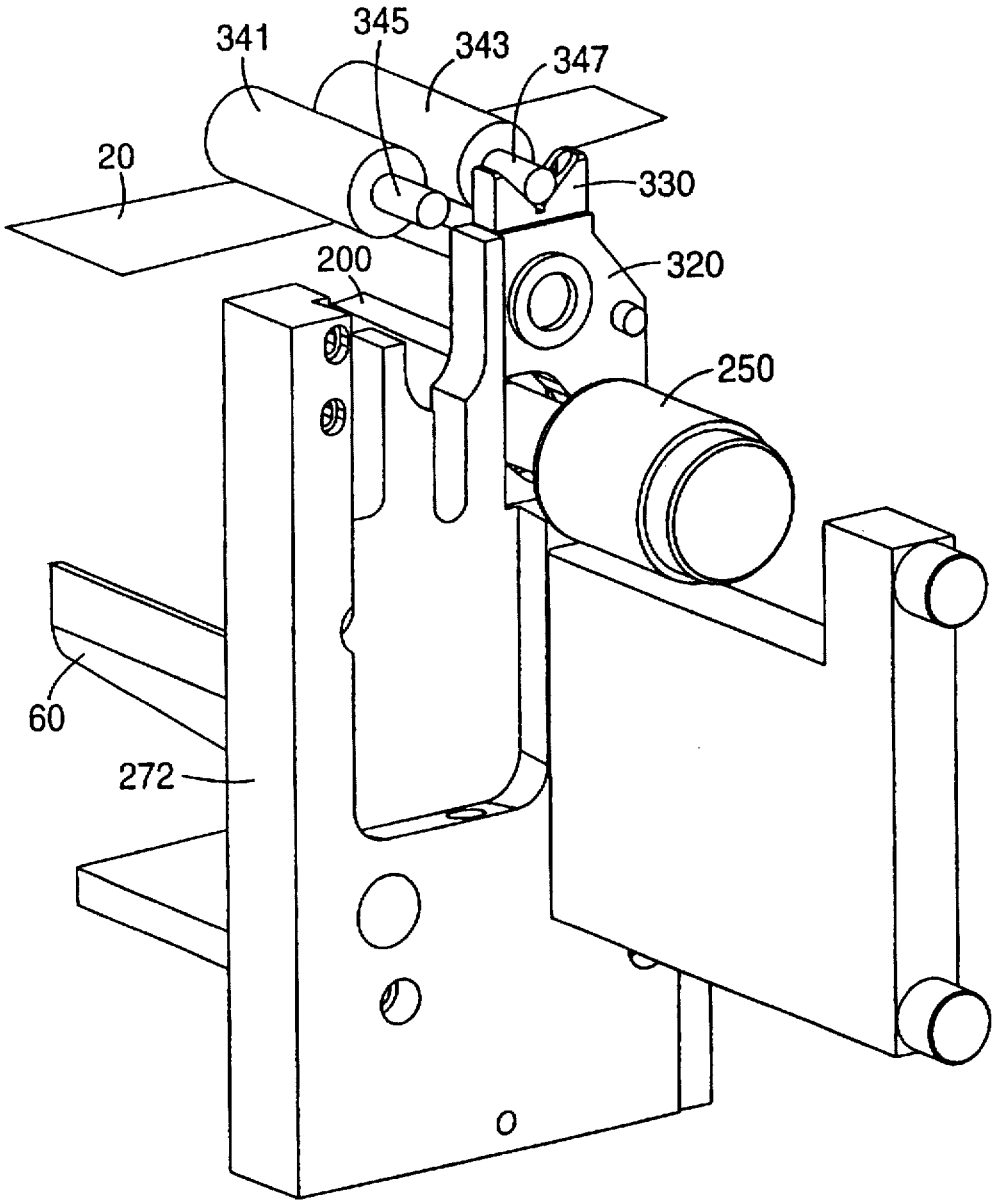
FIG. 29 is a partial perspective view of a mechanism for positioning the development apparatus relative to an imaging substrate, in accordance with the present invention.

FIG. 29 is a partial perspective view of the mechanism for positioning the development apparatus relative to an imaging substrate such as photoreceptor 20, in accordance with the present invention. As shown in FIG. 29, backup rollers 341, 343 may be mounted on a side of photoreceptor 20 opposite the development apparatus. Backup roller 341 includes a shaft 345 having ends that can be captured by positioning blocks 297, 299 to control the positioning of first squeegee relative to the backup roller. Backup roller 341 provides support to photoreceptor 20 in response to loading by first squeegee roller 56. Similarly, backup roller 343 includes a shaft 347 having ends that can be captured by positioning blocks 330, 332 to control the spacing between development roller 54 and photoreceptor 20. The positioning blocks 297, 299, 330, 332 and backup rollers 341, 343 together form a positioning mechanism. Positioning blocks 330, 332 enable positioning of the development apparatus relative to photoreceptor 20 without contacting the photoreceptor. The positioning mechanism thereby avoids disruption of the motion quality of photoreceptor 20 during the imaging process.

Figure 30:
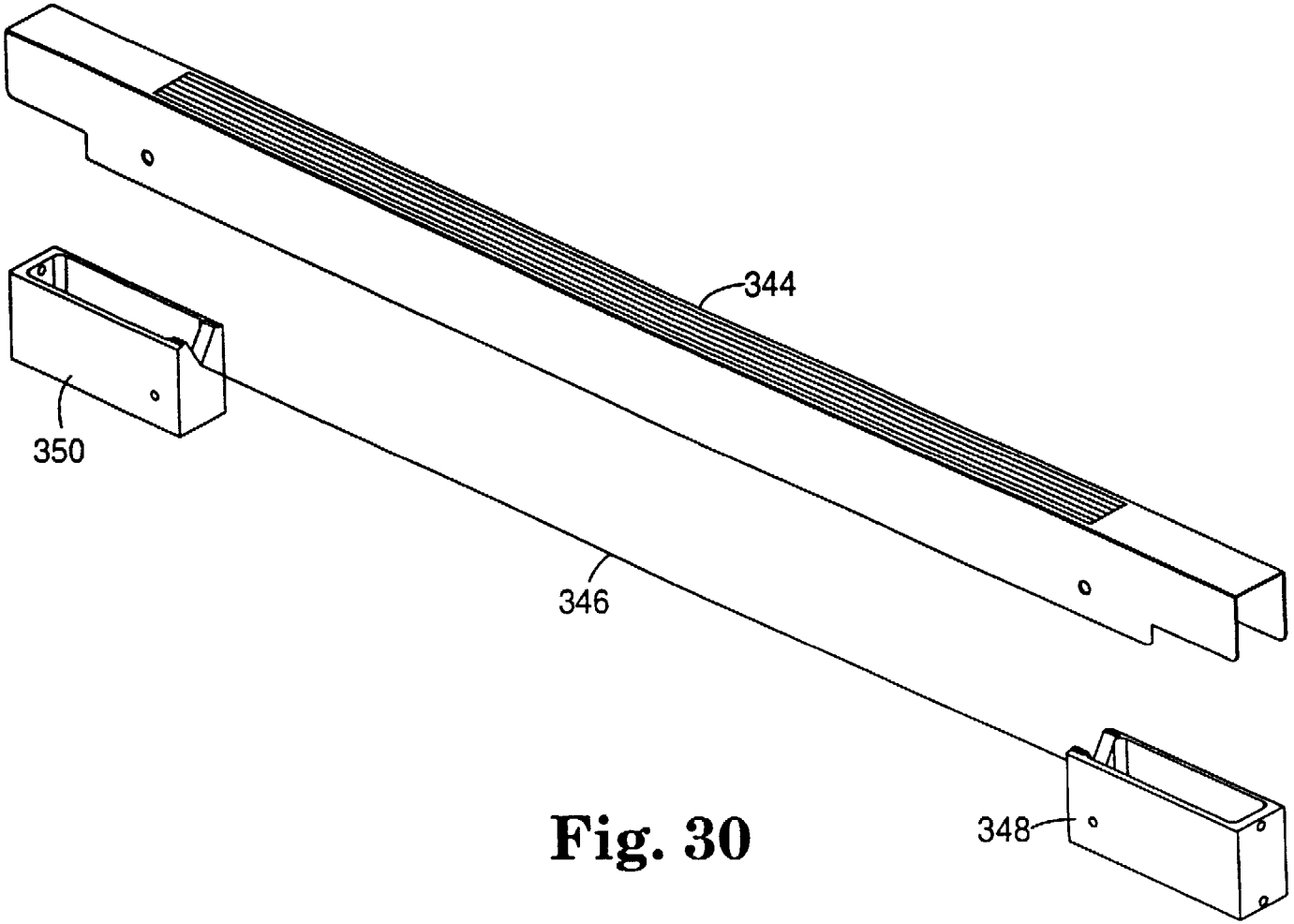
FIG. 30 is an exploded perspective view of a corona sub-assembly of the development apparatus of FIG. 25.

FIG. 30 is an exploded perspective view of a corona sub-assembly 270 of the development apparatus of FIG. 25. As shown in FIG. 30, corona sub-assembly 270 includes a grid 344, a corona wire 346, and a corona wire tensioning assembly having first and second tensioning blocks 348, 350. The incorporation of corona sub-assembly 270 is optional, but is desirable in each of the first three development stations 12, 14, 16 for multi-color imaging. Specifically, after photoreceptor 20 has been exposed and thereby discharged to form a latent image, and the latent image has been developed, corona sub-assembly 270 charges photoreceptor 20 to a potential necessary for the next exposure/development operation. For example, after first exposure station 32 has discharged photoreceptor 20 in an imagewise pattern to form a latent image, and first development station 12 has developed the latent image, a corona sub-assembly 270 in the first development station charges the photoreceptor prior to activation of the next exposure station 34 and the next development station 14.

Figure 31:
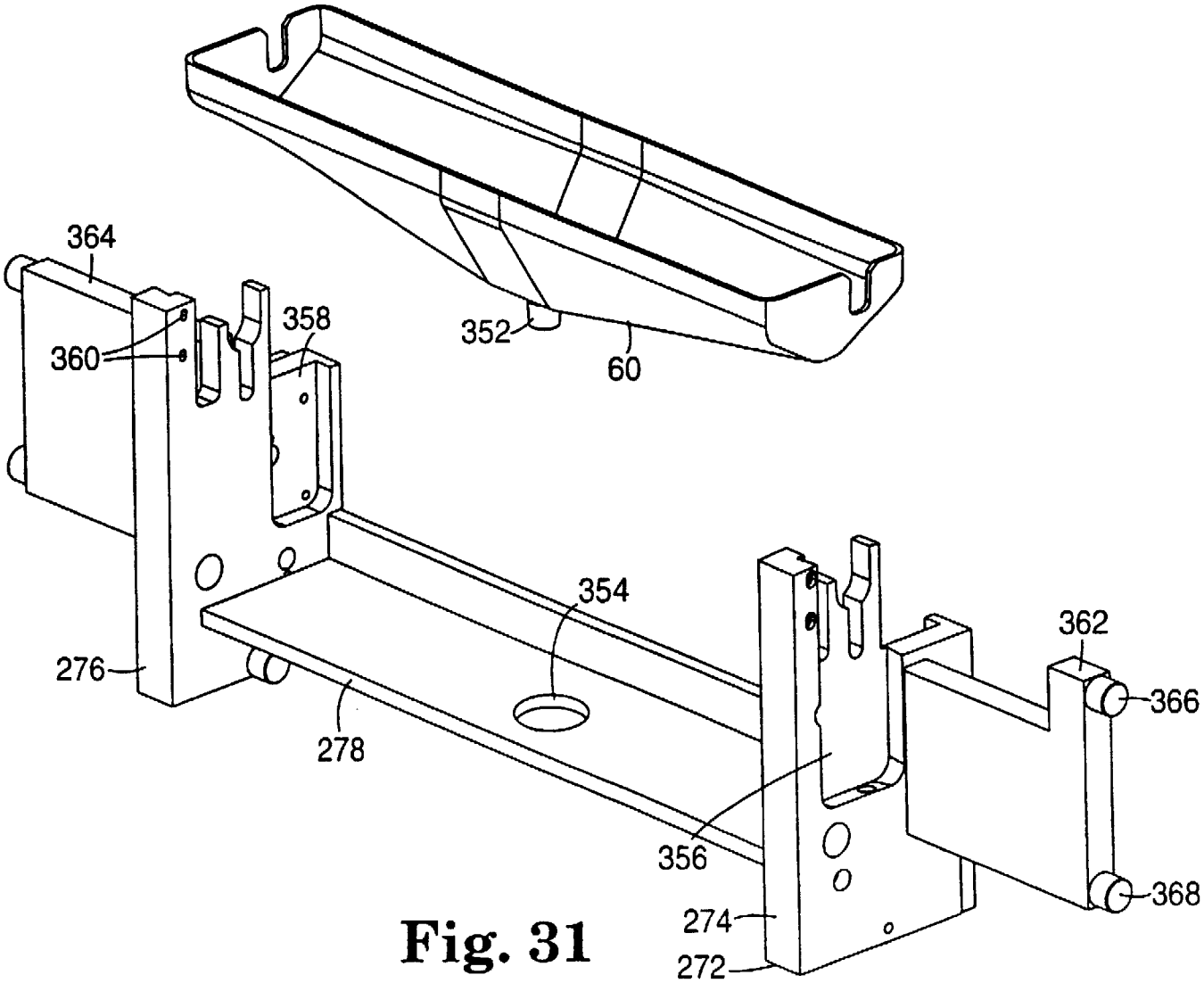
FIG. 31 is an exploded perspective view of a developer liquid recovery sub-assembly of the development apparatus of FIG. 25.

FIG. 31 is an exploded perspective view of a developer liquid recovery sub-assembly of the development apparatus of FIG. 25. As shown in FIG. 31, developer liquid recovery reservoir 60 includes a drain 352 that mounts into a drain hole 354 in cross member 278. A fluid line can be coupled to drain 352 and drain hole 354 to recover developer liquid from reservoir 60. As further shown in FIG. 31, each of first and second side plates 274, 276 of frame assembly 272 include an area for mounting squeegee sub-assembly 282, indicated by reference numeral 356, an area for mounting developer sub-assembly 280, indicated by reference numeral 358, and an area for mounting corona sub-assembly 270, indicated by reference numeral 360. The frame assembly 272 further includes guide plates 362, 364 extending perpendicular to first and second side plates 274, 276, respectively. Each of guide plates 362, 364 include guide posts 366, 368 that ride within vertical slots in a developer system housing, to be described with reference to FIG. 32.

Figure 32:
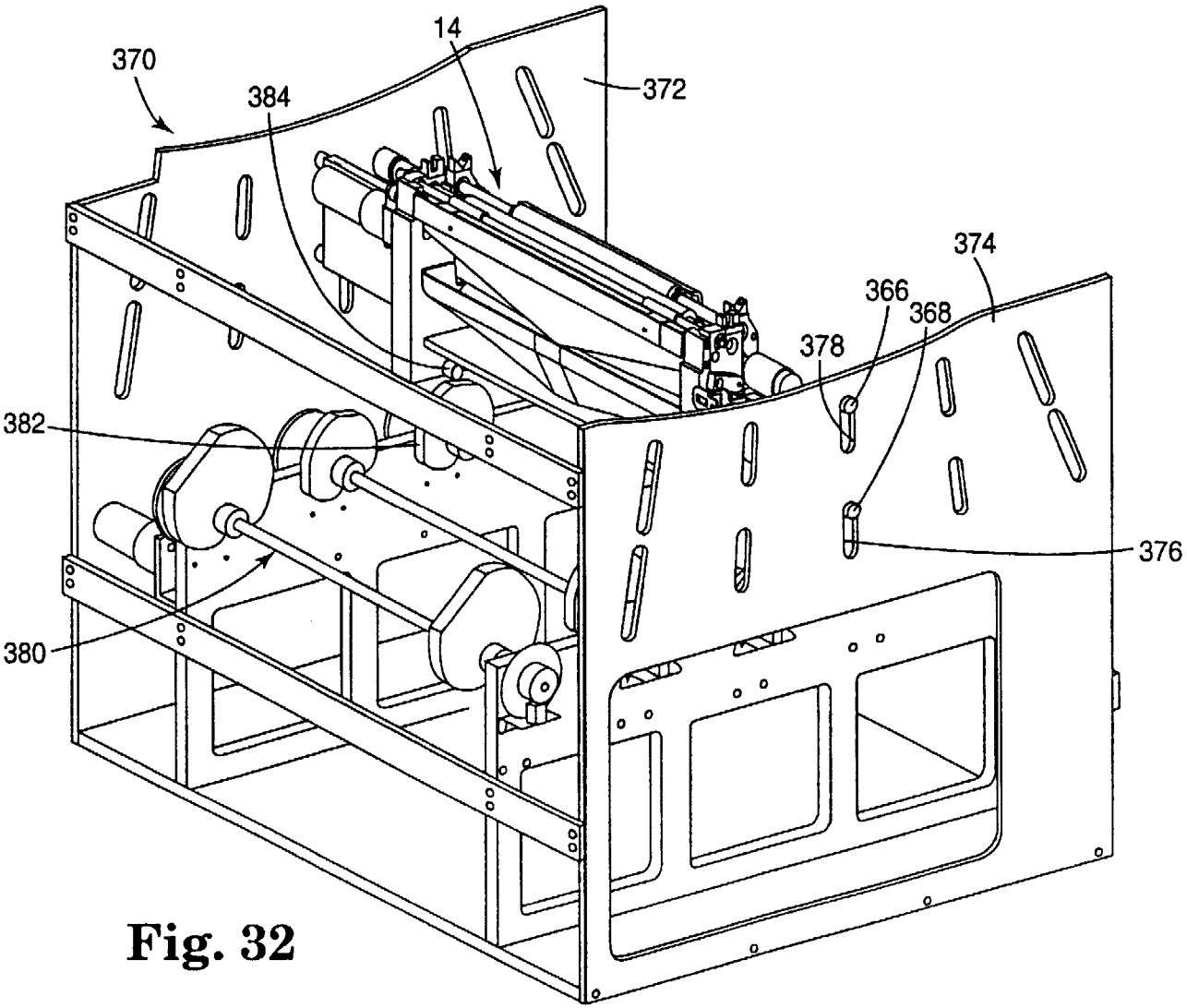
FIG. 32 is a perspective view of a multi-color developer system housing for supporting and actuating a plurality of development stations, in accordance with the present invention.

FIG. 32 is a perspective view of a multi-color developer system housing 370 for supporting and actuating a plurality of development stations, in accordance with the present invention. In FIG. 32, for ease of illustration, developer system housing 370 is shown with a single development station 14. The developer station 14 of FIG. 31 conforms to the development apparatus described above with reference to FIGS. 25-31. As shown in FIG. 32, developer system housing 370 includes first and second side walls 372, 374. Each of side walls 372, 374 includes a pair of vertically aligned slots 376, 378 adjacent each development station 12, 14, 16, 18. Each of guide posts 366, 368 extending outward from the development station rides vertically within one of slots 376, 378. The developer system housing 370 further includes for each development station 12, 14, 16, 18 a camming mechanism 380 including a pair of cams 382. The cams 382 are engaged with posts 384 on each development station 12, 14, 16, 18. The camming mechanism 380 rotates each cam 382 to elevate the respective development station 12, 14, 16, 18 upward and downward relative to photoreceptor 20. In this manner, development roller 54 can be engaged in proximity with photoreceptor 20 to deliver developer liquid, and first and second squeegee roller 56, 58 can be loaded against the photoreceptor to remove excess developer liquid.

The following non-limiting examples are provided to further illustrate the structure and functionality of a development apparatus, in accordance with the present invention.

EXAMPLE 1

This example relates to the fabrication and use in a development apparatus of a first squeegee roller 56 having a crowned profile. A right circular cylindrical metal shaft having a length of approximately 10.25 inches (26.04 centimeters) and a diameter of approximately 0.64 inches (1.63 centimeters) was machined to form a first end having a length of approximately 0.375 inches (0.95 centimeters) and a diameter of approximately 0.2 inches (0.5 centimeters), a second end having length of approximately 0.375 inches (0.95 centimeters) and a diameter of approximately 0.2 inches (0.5 centimeters), and a core extending between the first end and the second end along the central longitudinal axis of the shaft. The core had a length of approximately 9.5 inches (24.13 centimeters), and was machined to have a diameter that varied along the longitudinal axis. The diameter of the core was maximum at a midpoint of the core and minimum at opposite ends of the core. In particular, the core was machined to have a crowned profile determined by the following equation:

$$L=2[(Dmax-Dmin/2)(2r-(Dmax-Dmin/2))]^{1/2}$$

where the crowned profile conforms to an arc of a circle having a radius r, L is the length of the core, Dmax is a maximum diameter of the core along its length and the diameter of the core at its midpoint, and Dmin is a minimum diameter of the core along its length and the diameter of the core at each of its ends. In this example, r=540 inches (1371.6 centimeters), L=9.5 inches (24.13 centimeters), Dmax=0.625 inches (1.59 centimeters), and Dmin=0.565 inches (1.44 centimeters).

The core of the machined shaft was placed in a right circular cylindrical mold having a length of approximately 9 inches (22.9 centimeters) and a diameter of approximately 0.85 inches (2.16 centimeters). The core was concentric about a central longitudinal axis of the mold. After sealing the mold, an elastomeric material comprising polyurethane was injected into the mold. The elastomeric material had a durometer of approximately 55 to 65 Shore A when set. After allowing the elastomeric material to set, the shaft and elastomeric material were removed from the mold via a circular opening in an end of the mold. The core and elastomeric material of the resulting squeegee roller together had a crowned profile and an overall diameter that varied along the longitudinal axis of the shaft. The elastomeric material was ground to produce a right circular cylindrical squeegee roller in which the core and elastomeric material together produced an overall diameter that was substantially constant along the longitudinal axis of the shaft. The overall diameter of the core and ground elastomeric material was approximately 0.78 inches (1.98 centimeters). The grinding operation provided a texture to the elastomeric material characterized by a random roughness of approximately 40 AA (arithmetic average).

The first and second ends of the squeegee roller were placed in bearing mounts within a development station of a liquid electrographic imaging system. The development station was mounted adjacent a drum carrying a continuous photoreceptor belt within the imaging system. A loading force was applied to the bearing mounts via spring mechanisms to load the squeegee roller against the photoreceptor belt mounted on the drum. The photoreceptor belt had a width of approximately 11 inches (27.9 centimeters) extending parallel to the squeegee roller and a length of approximately 19.8 inches (50.3 centimeters) extending perpendicular to the squeegee roller. The squeegee roller and the photoreceptor belt formed a pressure nip having a length of approximately 9 inches (22.9 centimeters), slightly larger than the width of an imaging region of the photoreceptor belt.

The drum was driven to rotate the photoreceptor belt at a surface velocity of approximately 3 inches (7.62 centimeters) per second. The squeegee roller was frictionally driven by contact with the photoreceptor belt at the same surface velocity. The spring mechanisms were adjusted to experimentally determine a loading force sufficient to produce a substantially uniform force along the nip. It was determined that a loading force of approximately 4 pounds (1.8 kilograms) applied to each of the first end and the second end of the squeegee roller shaft was sufficient to produce such a substantially uniform force along the nip, given the structure of the squeegee roller described above. A loading force in a range of approximately 4 to 6 pounds (1.8 to 2.7 kilograms) also can be expected to provide acceptable uniformity of loading with effective film forming of developer liquid. In operation, the squeegee roller was observed to provide substantially uniform removal of developer liquid across the width of the imaging region of the photoreceptor, resulting in substantially uniform film forming and drying of the developer liquid forming the developed image.

EXAMPLE 2

This example relates to the fabrication and use in a development apparatus of a means, such as cleaning roller 64 described above, for removing back-plated toner from a development device. A piece of brass was machined to produce a shaft conforming substantially to shaft 200 shown in FIG. 21. A portion of the shaft having a hexagonal cross-section had a length of approximately 32.0 centimeters. The shaft had a dimension between opposing surfaces of the hexagon of approximately 1.27 centimeters. A longitudinal bore was formed in the shaft to form a central fluid flow channel. The central fluid flow channel had a diameter of approximately 0.62 centimeters and a length of approximately 30.8 centimeters. One-hundred and two radial flow channels were formed in the hexagonal portion of the shaft. Each of the radial fluid flow channels extended radially outward from the central fluid flow channel to an aperture in an outer surface of the shaft. Each of the radial fluid flow channels and the apertures had a diameter of approximately 0.26 centimeters. Each of the radial fluid flow channels had a length of approximately 0.32 centimeters. The radial fluid flow channels were spaced along the length of the hexagonal portion of the shaft. The radial fluid flow channels were divided into sets of three extending from a common section of the central fluid flow channel. Each set of three radial fluid flow channels was spaced from adjacent sets by approximately 0.64 centimeters along the length of the shaft. The radial fluid flow channels in each set were formed approximately 120 degrees from one another such that the channels terminated at apertures formed in alternating flat surfaces of the hexagonal shaft.

Sixty rings of SCOTCHBRITE# T T-TALC air laid fiber material were mounted about the hexagonal portion of the shaft. Each ring had a compressed thickness of approximately 0.36 centimeters extending along the length of the shaft when compressed with other rings on the shaft, and an uncompressed thickness of approximately 0.75 centimeters. Each ring had an overall diameter of approximately 2.54 centimeters. With a mounting aperture having a diameter of approximately 1.27 centimeters, each of the rings had a radial thickness extending outward from the shaft of approximately 0.64 centimeters. The rings were formed by punching discs out of a sheet of SCOTCHBRITE™ T-TALC air laid fiber material, and punching mounting apertures in the discs. Clips were used to hold the discs on the shaft. The shaft, with the fiber rings, was loaded against a development roller with a loading force of approximately 0.68 kilograms at each end.

A rotary union substantially as described with respect to FIGS. 5 and 6 was coupled to an end of the shaft having an open bore leading to the central fluid flow channel. A source of developer liquid was coupled to the rotary union and forced into the rotary union and the central fluid flow channel with a pump. Another end of the shaft was coupled to a gear. The gear was driven by a motor to rotate the shaft at a rate of approximately 57 rpm. The pump was adjusted to force developer liquid into the central fluid flow channel at a flow rate of approximately 0.5 liters/minute. As the shaft was rotated, the fiber rings removed back-plated developer from the development roller. At the same time, the developer liquid forced into the central fluid flow channel was forced out of the radial fluid flow channels and through the fiber rings, flushing away the removed back-plated developer.

Having described the exemplary embodiments of the present invention, additional advantages and modifications will readily occur to those skilled in the art from consideration of the specification and practice of the invention disclosed herein. Therefore, the specification and examples should be considered exemplary only, with the true scope and spirit of the invention being indicated by the following claims.

What is claimed is:

1. A development system for developing a latent electrostatic image on an imaging substrate in a liquid electrographic imaging seem, the imaging substrate being moved in a first direction during development of the latent image, the development system comprising:

development device for delivering developer liquid to an imaging region of the imaging substrate to develop the latent electrostatic image;

a first squeegee roller positioned to provide contact between the first squeegee roller and the imaging substrate, the first squeegee roller being driven by the imaging substrate in the first direction, wherein the first squeegee roller removes from an imaging region of the imaging substrate first excess developer liquid applied by the development device during development of the latent electrostatic image in the imaging region of the imaging substrate, wherein the first squeegee roller removes the first excess developer liquid from the imaging substrate at an upstream side of the first squeegee roller relative to the first direction of movement of the imaging substrate, and wherein a portion of the first excess developer liquid passes to a downstream side of the first squeegee roller, the portion of the first excess developer liquid being transferred from the first squeegee roller to the imaging substrate;

a first drive mechanism for driving the first squeegee roller in a second direction opposite to the first direction upon movement of a nonimaging region of the imaging substrate past the first squeegee roller, the first squeegee roller substantially removing from the imaging substrate second excess developer liquid formed by termination of application of the developer liquid to the imaging substrate by the development device;

a second squeegee roller positioned to provide contact between the second squeegee roller and the imaging substrate at a position adjacent the downstream side of the first squeegee roller; and a second drive mechanism for driving the second squeegee roller in the second direction opposite to the first direction, the second squeegee roller removing from the imaging substrate the portion of the first excess developer liquid transferred from the first squeegee roller.

2. The development system of claim 1, further comprising a mechanism for removing from the first squeegee roller at least a portion of the second excess developer liquid removed from the imaging substrate by the first squeegee roller during movement of the first squeegee roller in the second direction, and a mechanism for removing from the second squeegee roller at least a portion of the first excess developer liquid removed from the imaging substrate by the second squeegee roller.

3. The development system of claim 1, wherein the second squeegee roller includes a first squeegee section and a second squeegee section mounted about a common roller shaft, the first squeegee section being positioned to remove from the imaging substrate the portion of the first excess developer liquid transferred from the first squeegee roller at a first end of the first squeegee roller, and the second squeegee section being positioned to remove from the imaging substrate the portion of the first excess developer liquid transferred from the first squeegee roller at a second end of the first squeegee roller.

4. The development system of claim 1, wherein the developer liquid can produce back-plated developer material on the development device, the system further comprising:

a shaft;

cleaning media mounted about the outer surface of the shaft, the shaft being positioned to provide contact between the cleaning media and the development device;

a fluid flow mechanism for delivering a cleaning liquid to the cleaning media; and a third drive mechanism for rotating the shaft and cleaning media, wherein the cleaning media removes the back-plated material from the development device and the cleaning liquid flushes at least a portion of the removed back-plated material from the cleaning media.

5. The development system of claim 4, wherein the fluid flow mechanism comprises a central fluid flow channel extending along a longitudinal axis of the shaft and a plurality of radial fluid flow channels extending radially outward from the central fluid flow channel to the outer surface of the shaft, and the central fluid flow channel delivers the cleaning liquid to the radial fluid flow channels and the radial fluid flow channels deliver the cleaning liquid to the outer surface of the shaft, and wherein the cleaning media includes a plurality of flow paths, the cleaning liquid being transmitted through the flow paths to flush the removed back-plated material from the cleaning media.

6. The development system of claim 4, wherein the first squeegee roller has a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis, wherein each of the first end and the second end receives a loading force to load the core of the first squeegee roller against the imaging substrate, thereby forming a pressure nip between the elastomeric material and the imaging substrate, and wherein the cross-sectional area of the core and the loading force are selected to produce a substantially uniform pressure along the nip, the first squeegee roller thereby removing the first and second excess developer liquid from the imaging substrate in a substantially uniform manner.

7. The development system of claim 6, wherein the cross-sectional area of the core of the first squeegee roller is substantially circular, the core having a crowned profile such that the cross-sectional area of the core has a diameter that varies along the longitudinal axis of the core, wherein the diameter is maximum at a midpoint of the core along the longitudinal axis.

8. The development system of claim 1, wherein the first squeegee roller has a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis, wherein each of the first end and the second end receives a loading force to load the core of the first squeegee roller against the imaging substrate, thereby forming a pressure nip between the elastomeric material and the imaging substrate, and wherein the cross-sectional area of the core and the loading force are selected to produce a substantially uniform pressure along the nip, the first squeegee roller thereby removing the first and second excess developer liquid from the imaging substrate in a substantially uniform manner.

9. The development system of claim 8, wherein the cross-sectional area of the core of the first squeegee roller is substantially circular, the core having a crowned profile such that the cross-sectional area of the core has a diameter that varies along the longitudinal axis of the core, wherein the diameter is maximum at a midpoint of the core along the longitudinal axis.

10. A development system for developing a latent electrostatic image on an imaging substrate in a liquid electrographic imaging system, the imaging substrate being moved in a first direction during development of the latent image, the development system comprising:

a development device for delivering developer liquid to an imaging region of the imaging substrate to develop the latent electrostatic image;

a squeegee roller positioned to provide contact between the squeegee roller and the imaging substrate, the squeegee roller being driven by the imaging substrate in the first direction, wherein the squeegee roller removes from an imaging region of the imaging substrate first excess developer liquid applied by the development device during development of the latent electrostatic image in the imaging region of the imaging substrate; and a drive mechanism for driving the squeegee roller in a second direction opposite to the first direction upon movement of a nonimaging region of the imaging substrate past the squeegee roller, the squeegee roller substantially removing from the imaging substrate second excess developer liquid formed by termination of application of developer liquid to the imaging substrate by the development device, wherein the squeegee roller has a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis, wherein each of the first end and the second end receives a loading force to load the core of the squeegee roller against the imaging substrate, thereby forming a pressure nip between the elastomeric material and the imaging substrate, and wherein the cross-sectional area of the core and the loading force are selected to produce a substantially uniform pressure along the nip, the squeegee roller thereby removing the first and second excess developer liquid from the imaging substrate in a substantially uniform manner.

11. The development system of claim 10, wherein the cross-sectional area of the core of the squeegee roller is substantially circular, the core having a crowned profile such that the cross-sectional area of the core has a diameter that varies along the longitudinal axis of the core, wherein the diameter is maximum at a midpoint of the core along the longitudinal axis.

12. The development system of claim 10, further comprising a mechanism for removing from the squeegee roller at least a portion of the second excess developer liquid removed from the imaging substrate by the squeegee roller during movement of the squeegee roller in the second direction.

13. A development system for developing a latent electrostatic image on an imaging substrate in a liquid electrographic imaging system, the imaging substrate being moved in a first direction during development of the latent image, the development system comprising:

a development device for delivering developer liquid to an imaging region of the imaging substrate to develop the latent electrostatic image;

a squeegee roller positioned to provide contact between the squeegee roller and the imaging substrate, the squeegee roller being driven by the imaging substrate in the first direction, wherein the squeegee roller being removes from an imaging region of the imaging substrate first excess developer liquid applied by the development device during development of the latent electrostatic image in the imaging region of the imaging substrate; and a drive mechanism for driving the squeegee roller in a second direction opposite to the first direction upon movement of a nonimaging region of the imaging substrate past the squeegee roller, the squeegee roller substantially removing from the imaging substrate second excess developer liquid formed by termination of application of the developer liquid to the imaging substrate by the development device, wherein the developer liquid can produce back-plated developer material on the development device, the system further comprising:

a shaft, cleaning media mounted about the outer surface of the shaft, the shaft being positioned to provide contact between the cleaning media and the development device, a fluid flow mechanism for delivering a cleaning liquid to the cleaning media, and a second drive mechanism for rotating the shaft and the cleaning media, wherein the cleaning media removes the back-plated material from the development device and the cleaning liquid flushes at least a portion of the removed back-plated material from the cleaning media.

14. The development system of claim 13, wherein the fluid flow mechanism comprises a central fluid flow channel extending along a longitudinal axis of the shaft and a plurality of radial fluid flow channels extending radially outward from the central fluid flow channel to the outer surface of the shaft, and the central fluid flow channel delivers the cleaning liquid to the radial fluid flow channels and the radial fluid flow channels deliver the cleaning liquid to the outer surface of the shaft, and wherein the cleaning media includes a plurality of flow paths, the cleaning liquid being transmitted through the flow paths to flush the removed back-plated material from the cleaning media.

15. The development system of claim 13, further comprising a mechanism for removing from the squeegee roller at least a portion of the second excess developer liquid removed from the imaging substrate by the squeegee roller during movement of the squeegee roller in the second direction.

16. A development system for developing a latent electrostatic image on a imaging substrate in a liquid electrographic imaging system, the imaging substrate being moved in a first direction during development of the latent image, the development system comprising:

a development device for delivering developer liquid to an imaging region of the imaging substrate to develop the latent electrostatic image;

a first squeegee roller positioned to provide contact between the first squeegee roller and the imaging substrate, the first squeegee roller being driven by the imaging substrate in the first direction, wherein the first squeegee roller removes from an imaging region of the imaging substrate excess developer liquid applied by the development device during development of the latent electrostatic image in the imaging of the imaging substrate, wherein the first squeegee roller removes the excess developer liquid from the imaging substrate at an upstream side of the first squeegee roller relative to the first direction of movement of the imaging substrate, and wherein a portion of the excess developer liquid passes to a downstream side of the first squeegee roller, the portion of the excess developer liquid being transferred from the first squeegee roller to the imaging substrate;

a second squeegee roller positioned to provide contact between the second squeegee roller and the imaging substrate at a position adjacent the downstream side of the first squeegee roller; and a drive mechanism for driving the second squeegee roller in the second direction opposite to the first direction, the second squeegee roller removing from the imaging substrate the portion of the excess developer liquid transferred from the first squeegee roller, wherein the developer liquid can produce back-plated developer material on the development device, the system further comprising:

a shaft, cleaning media mounted about the outer surface of the shaft, the shaft being positioned to provide contact between the cleaning media and the development device, fluid flow mechanism for delivering a cleaning liquid to the cleaning media, and a third drive mechanism for rotating the shaft and cleaning media, wherein the cleaning media removes the back-plated material from the development device and the cleaning liquid flushes at least a portion of the removed back-plated material from the cleaning media.

17. The development system of claim 16, further comprising a mechanism for removing from the second squeegee roller at least a portion of the excess developer liquid removed from the imaging substrate by the second squeegee roller.

18. The development system of claim 16, wherein the second squeegee roller includes a first squeegee section and a second squeegee section mounted about a common roller shaft, the first squeegee section being positioned to remove from the imaging substrate the portion of the excess developer liquid transferred from the first squeegee roller at a first end of the first squeegee roller, and the second squeegee section being positioned to remove from the imaging substrate the portion of the excess developer liquid transferred from the first squeegee roller at a second end of the first squeegee roller.

19. The development system of claim 16, wherein the fluid flow mechanism comprises a central fluid flow channel extending along a longitudinal axis of the shaft and a plurality of radial fluid flow channels extending radially outward from the central fluid flow channel to the outer surface of the shaft, and the central fluid flow channel delivers the cleaning liquid to the radial fluid flow channels and the radial fluid flow channels deliver the cleaning liquid to the outer surface of the shaft, and wherein the cleaning media includes a plurality of flow paths, the cleaning liquid being transmitted through the flow paths to flush the removed back-plated material from the cleaning media.

20. The development system of claim 16, wherein the first squeegee roller has a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis, wherein each of the first end and the second end receives a loading force to load the core of the first squeegee roller against the imaging substrate, thereby forming a pressure nip between the elastomeric material and the imaging substrate, and wherein the cross-sectional area of the core and the loading force are selected to produce a substantially uniform pressure along the nip, the first squeegee roller thereby removing the excess developer liquid from the imaging substrate in a substantially uniform manner.

21. The development system of claim 20, wherein the cross-sectional area of the core of the first squeegee roller is substantially circular, the core having a crowned profile such that the cross-sectional area of the core has a diameter that varies along the longitudinal axis of the core, wherein the diameter is maximum at a midpoint of the core along the longitudinal axis.

22. A development system for developing a latent electrostatic image on an imaging substrate in a liquid electrographic imaging system, the imaging substrate being moved in a first direction during development of the latent image, the development system comprising:

a development device for delivering developer liquid to an imaging region of the imaging substrate to develop the latent electrostatic image;

a squeegee roller positioned to provide contact between the squeegee roller and the imaging substrate, the squeegee roller being driven by the imaging substrate in the first direction, wherein the squeegee roller removes from an imaging region of the imaging substrate excess developer liquid applied by the development device during development of the latent electrostatic image in the imaging region of the imaging substrate;

wherein the squeegee roller has a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis, wherein each of the first end and the second end receives a loading force to load the core of the squeegee roller against the imaging substrate, thereby forming a pressure nip between the elastomeric material and the imaging substrate, wherein the cross-sectional area of the core and the loading force are selected to produce a substantially uniform pressure along the nip, the squeegee roller thereby removing the excess developer liquid from the imaging substrate in a substantially uniform manner, and wherein the developer liquid can produce back-plated developer material on the development device, the system further comprising:

a shaft, cleaning media mounted about the outer surface of the shaft, the shaft being positioned to provide contact between the cleaning media and the development device, a fluid flow mechanism for delivering a cleaning liquid to the cleaning media, and a drive mechanism for rotating the shaft and cleaning media, wherein the cleaning media removes the back-plated material from the development device and the cleaning liquid flushes at least a portion of the removed back-plated material from the cleaning media.

23. The development system of claim 22, wherein the cross-sectional area of the core of the squeegee roller is substantially circular, the core having a crowned profile such that the cross-sectional area of the core has a diameter that varies along the longitudinal axis of the core, wherein the diameter is maximum at a midpoint of the core along the longitudinal axis.

24. The development system of claim 22, wherein the fluid flow mechanism comprises a central fluid flow channel extending along a longitudinal axis of the shaft and a plurality of radial fluid flow channels extending radially outward from the central fluid flow channel to the outer surface of the shaft, and the central fluid flow channel delivers the cleaning liquid to the radial fluid flow channels and the radial fluid flow channels deliver the cleaning liquid to the outer surface of the shaft, and wherein the cleaning media includes a plurality of flow paths, the cleaning liquid being transmitted through the flow paths to flush the removed back-plated material from the cleaning media.

25. A development system for developing an image on an imaging substrate, the imaging substrate being moved in a first direction during development of the image, the development system comprising:

a development device for delivering developer liquid to an imaging region of the imaging substrate to develop the image;

a first squeegee roller positioned to provide contact between the first squeegee roller and the imaging substrate, the first squeegee roller being driven by the imaging substrate in the first direction;

a first drive mechanism for selectively driving the first squeegee roller in a second direction opposite to the first direction;

a second squeegee roller positioned to provide contact between the second squeegee roller and the imaging substrate at a position adjacent a downstream side of the first squeegee roller; and a second drive mechanism for driving the second squeegee roller in the second direction opposite to the first direction.

26. The development system of claim 25, wherein the developer liquid can produce back-plated developer material on the development device, the system further comprising:

a shaft;

cleaning media mounted about the outer surface of the shaft, the shaft being positioned to provide contact between the cleaning media and the development device;

a fluid flow mechanism for delivering a cleaning liquid to the cleaning media; and a third drive mechanism for rotating the shaft and cleaning media, wherein the cleaning media removes the back-plated material from the development device and the cleaning liquid flushes at least a portion of the removed back-plated material from the cleaning media.

27. A development system for developing an image on an imaging substrate, the imaging substrate being moved in a first direction during development of the image, the development system comprising:

a development device for delivering developer liquid to an imaging region of the imaging substrate to develop the image;

a squeegee roller positioned to provide contact between the squeegee roller and the imaging substrate, the squeegee roller being driven by the imaging substrate in the first direction; and a drive mechanism for selectively driving the squeegee roller in a second direction opposite to the first direction, wherein the squeegee roller has a shaft with a first end, a second end, and a core extending between the first end and the second end along a longitudinal axis of the shaft, and an elastomeric material formed about the core, wherein the core has a cross-sectional area oriented perpendicular to the longitudinal axis that varies along the longitudinal axis, wherein each of the first end and the second end receives a loading force to load the core of the squeegee roller against the imaging substrate, thereby forming a pressure nip between the elastomeric material and the imaging substrate, and wherein the cross-sectional area of the core and the loading force are selected to produce a substantially uniform pressure along the nip, the squeegee roller thereby removing the first and second excess developer liquid from the imaging substrate in a substantially uniform manner.

28. A development system for developing an image on an imaging substrate, the imaging substrate being moved in a first direction during development of the image, the development system comprising:

a development device for delivering developer liquid to an imaging region of the imaging substrate to develop the image;

a squeegee roller positioned to provide contact between the squeegee roller and the imaging substrate, the squeegee roller being driven by the imaging substrate in the first direction; and a drive mechanism for selectively driving the squeegee roller in a second direction opposite to the first direction, wherein the developer liquid can produce back-plated developer material on the development device, the system further comprising:

a shaft, cleaning media mounted about the outer surface of the shaft, the shaft being positioned to provide contact between the cleaning media and the development device, a fluid flow mechanism for delivering a cleaning liquid to the cleaning media, and a second drive mechanism for rotating the shaft and the cleaning media, wherein the cleaning media removes the back-plated material from the development device and the cleaning liquid flushes at least a portion of the removed back-plated material from the cleaning media.

* * * * *